US007470495B2

(12) United States Patent
Ono et al.

(10) Patent No.: US 7,470,495 B2
(45) Date of Patent: Dec. 30, 2008

(54) ELECTROPHOTOGRAPHIC TONER AND IMAGE FORMING METHOD

(75) Inventors: Kaori Ono, Hino (JP); Satoru Ikesu, Fuchu (JP); Koji Daifuku, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 439 days.

(21) Appl. No.: 11/240,967

(22) Filed: Sep. 30, 2005

(65) Prior Publication Data

US 2006/0093935 A1 May 4, 2006

(30) Foreign Application Priority Data

Oct. 8, 2004 (JP) ..... 2004-296024

(51) Int. Cl.
*G03G 9/08* (2006.01)

(52) U.S. Cl. ..... 430/108.1; 430/110.1; 430/108.4

(58) Field of Classification Search ..... 430/108.1, 430/110.1, 108.4
See application file for complete search history.

(56) References Cited

U.S. PATENT DOCUMENTS 6,268,103 B1 * 7/2001 Hopper et al. ..... 430/137.14
2002/0039699 A1 * 4/2002 Nishimori et al. ..... 430/137.11
2003/0049559 A1 * 3/2003 Shigemori et al. ..... 430/137.18
2003/0138714 A1 * 7/2003 Hayashi et al. ..... 430/108.3
2004/0013961 A1 * 1/2004 Niwa et al. ..... 430/107.1
2005/0048393 A1 * 3/2005 Ota ..... 430/137.15
2005/0064314 A1 * 3/2005 Fujino et al. ..... 430/110.2
2005/0100809 A1 * 5/2005 Fujino et al. ..... 430/110.2
2005/0136354 A1 * 6/2005 Ueda et al. ..... 430/110.2

FOREIGN PATENT DOCUMENTS

JP 2-166467 * 6/1990

OTHER PUBLICATIONS

English language Abstract of JP 02166467 A. Jun. 27, 1990.*

* cited by examiner

*Primary Examiner*—Hoa V Le
(74) *Attorney, Agent, or Firm*—Squire, Sanders & Dempsey L.L.P.

(57) ABSTRACT

An electrophotographic toner exhibiting superior color reproducibility and transparency and improved characteristics is disclosed, comprising a thermoplastic resin and colored microparticles dispersed in the thermoplastic resin and containing a dye and a resin differing in composition from the thermoplastic resin. An image forming method by use of the toner is also disclosed.

7 Claims, 1 Drawing Sheet

ELECTROPHOTOGRAPHIC TONER AND IMAGE FORMING METHOD

This application claims priority from Japanese Patent Application No. JP2004-296024, filed on Oct. 8, 2004, which is incorporated hereinto by reference.

FIELD OF THE INVENTION

The present invention relates to a toner for use in electrophotograpy and an image forming method by use thereof.

BACKGROUND OF THE INVENTION

Recently, color-copying methods have come into practical use, in which an electrostatic latent image carrier is exposed to spectrally separated light to form an electrostatic latent image of an original and the latent image is further developed with color toners to obtain a colored copy image or the respective color copy images are superimposed to obtain a full color copy image. As toner used in the foregoing are manufactured color toners of yellow, magenta, cyan and the like which are formed by dispersing a dye and/or pigment of the respective colors in a binder resin.

The foregoing electrophotographic process, in general, forms images in accordance with the following steps. First, exposing light information in response to image information onto an electrostatic latent image carrier (hereinafter, also denoted as a photoreceptor) composed of a photoconductive material, through various methods forms a latent image on the photoreceptor. The electrostatic latent image formed on the photoreceptor is developed with a charged toner to form a toner image. The formed toner image is transferred onto an image recording medium (hereinafter, also denoted as transfer material) and fixed onto the transfer material using a thermal fixing apparatus.

In the foregoing color image forming method employing the electrophotographic process, electrostatic latent images formed on the photoreceptor correspond to image information which have been separated to the respective colors of yellow, magenta, cyan and black and developed with a toner having a color identical to the respective image information. The development step is repeated four times for the respective colors to form a full color image.

Organic pigments and dyes known in the art have conventionally been used as a colorant used for electrophotographic toner but they exhibit various defects. For instance, organic pigments are generally superior in heat resistance or lightfastness, compared to dyes but existing in toner particles in the form of granular dispersion results in enhanced masking, leading to reduced transparency. In general, low dispersibility of pigments results in deteriorated transparency and lowered chromaticness, deteriorating color reproducibility of images.

When different color toners are superimposed, transparency of fixed toners is needed to visually confirm color of a toner existing in the lowest layer. Dispersibility or coloring power of a colorant become necessary to maintain color reproducibility of an original.

To overcome the foregoing defects of pigments, there were proposed a technique for enhancing transparency in which application of a flushing process as a means for dispersing pigments achieved a pigment dispersion diameter in the order of sub-microns, formed of primary particles without forming aggregated secondary particles; and a technique for improving electrification property, fixability and image uniformity by covering pigment particles with a binding resin or a shelling resin, as described, for example, in JP-A Nos. 9-26673 and 11-160914 (hereinafter, the term, JP-A refers to Japanese Patent Application Publication).

However, even when forming toner images by using the thus proposed toner, it is difficult to achieve sufficient transparency, specifically in the case of a pigment toner.

In color imaging apparatuses, all of color reproduction can be achieved, in principle, by a subtractive color system using the three primary colors of yellow, magenta and cyan. In practice, however, the spectral property provided when dispersing a pigment in thermo-plastic resin or the color-mixing characteristic provided when superimposing different toners results in a reduced range of color reproducibility or lowered chromaticness so that problems to be overcome still remain to achieve faithful color reproduction of an original.

There were also introduced toners using dyes and toners using a mixture of a dye and a pigment. In a toner using a dye, the dye existed in the form of being dissolved in a binding binder so that superior transparency and chromaticness were achieved but inferior lightfastness or heat resistance resulted as compared to pigments, as described, for example, in JP-A Nos. 5-11504 and 5-34980.

With respect to heat resistance, in addition to lowered density due to decomposition of a dye, there were produced problems that when fixing a toner image by a heated roller, the dye was sublimed, easily causing in-machine staining and it was also dissolved in silicone oil used in the fixing stage and finally adhered to the heated roller, causing the so-called off-set phenomenon. To overcome such defects of dyes, there were proposed a technique of using specific anthraquinone type dyes as a magenta toner to improve lightfastness and sublimation ability in compatible with color reproduction and an encapsulated toner in which a core containing polymer resin and a color dye was covered with a polymer, as described, for example, in JP-A Nos. 5-72792 and 8-69128.

However, even when forming toner images using electrophotographic toners, as proposed above, it was difficult to achieve sufficient heat resistance (sublimation resistance) and lightfastness.

SUMMARY OF THE INVENTION

The present invention has come into being as a result of the extensive study to overcome the foregoing problems. It is an object of the present invention to provide a toner for electrophotography enabling superior coloring without producing any problems in dispersion in thermo-plastic resin and exhibiting superior color reproducibility and transparency and improved charging property, off-set resistance and heat resistance.

Thus, in one aspect the present invention is directed to an electrophotographic toner comprising a thermoplastic resin and colored microparticles dispersed in the thermoplastic resin and containing a dye and a resin differing in composition from the thermoplastic resin.

In another aspect the invention is directed to an image forming method comprising developing an electrostatic latent image formed on a support for the electrostatic image with a toner to form a toner image, and transferring the formed toner image to a transfer material, wherein the toner is the electrophotographic toner, as described above.

DETAILED DESCRIPTION OF THE INVENTION

In one aspect of this invention, the toner for electrophotography (hereinafter, also denoted simply as a toner) comprises a thermoplastic resin and colored microparticles dispersed in the thermoplastic resin, and the colored microparticles contain a resin having a composition different from the thermoplastic resin and a dye. Thus, instead of dispersing or dissolving a dye in a binding resin used for a toner generally known as a toner using a dye, colored microparticles which contain a resin differing in composition from the foregoing thermoplastic resin and a dye, are dispersed in the thermoplastic resin.

A dye of the colored microparticles is dissolved in the resin at the molecular level, enabling elimination of a component such as covering particles to shield light, whereby enhanced transparency of a single-color toner results and transparency of superposed colors is also enhanced.

Constitution of the toner of this invention will now be described with reference to illustrations.

Figure 1:
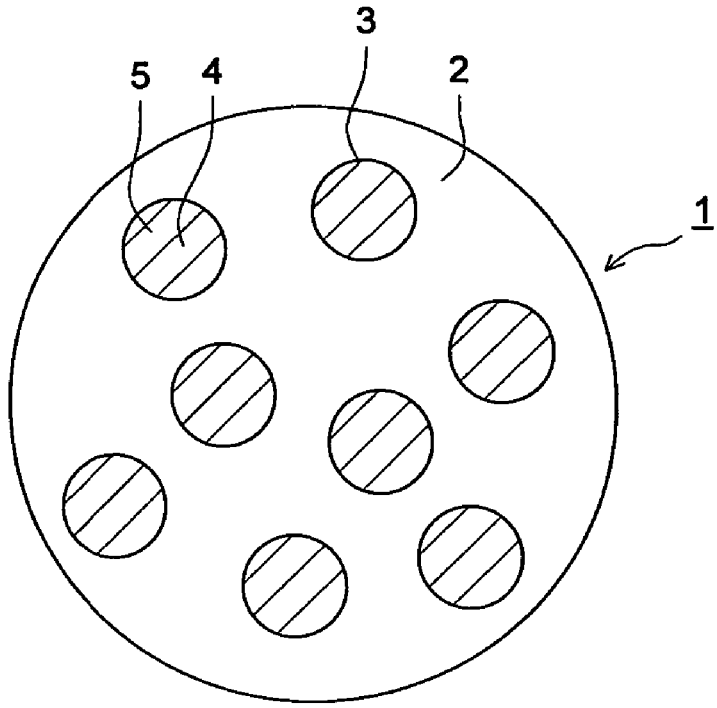
FIG. 1 illustrates the section of a toner particle containing colored microparticles dispersed in thermoplastic resin.

FIG. 1 is a sectional view of a toner particle (1) comprised of colored microparticles dispersed in thermo-plastic resin. In FIG. 1, numeral 1 designates a toner particle, numeral 2 is thermoplastic resin, numeral 3 is a colored microparticle, numeral 4 is a resin and numeral 5 designates a dye. As apparent from FIG. 1, the toner particle is composed of a thermoplastic resin in which colored microparticles are dispersed, and the microparticles are each composed of a resin and a dye.

Figure 2:
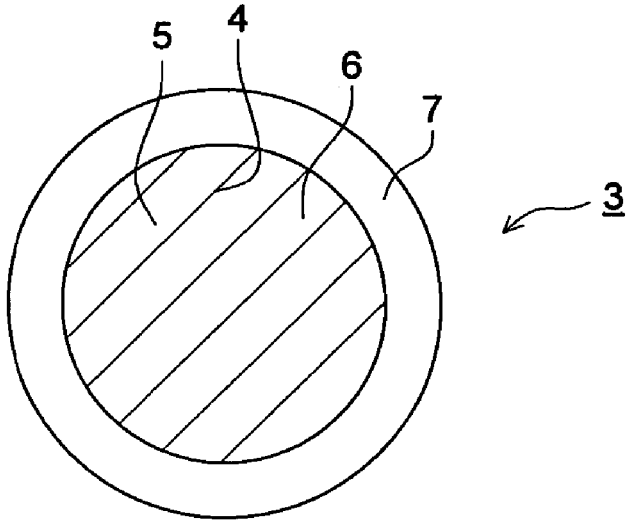
FIG. 2 illustrates the section of a colored microparticle having a core/shell structure, formed of a core covered with a shell resin.

As shown in FIG. 2, the toner particle may be a particular resin composed of a particular interior (core) containing resin and a dye, and further thereon, covered with a shell resin (or denoted simply as a shell). In that case, the combination of a resin forming the interior (core) of colored microparticles with a thermoplastic resin (binding resin) is not specifically limited, the degree of freedom is broad with respect to material. If only a shell resin (core) is identical with respect to four colors of the toner (yellow, magenta, cyan, black), manufacturing is performed under similar conditions, leading to enhanced advantage in cost. Migration of a colorant dye to the outside of the particular resin (bleeding-out onto the surface of the colored microparticle) does not occur so that there is no fear of sublimation of a dye or oil staining during fixing which is often caused in conventional dye toners.

FIG. 2 illustrates the section of a colored microparticle (3) having a core/shell structure, formed of a core covered with a shell resin. In FIG. 2, numeral 6 designates the interior (core) and numeral 7 designates the exterior resin (or shell), in which the interior (core) is a microparticle containing a resin and a dye.

Preparation of colored microparticles relating to this invention will now be described.

The colored microparticles can be obtained by dissolving (or dispersing) a resin and a dye in an organic solvent and emulsifying them in water, followed by removal of the organic solvent. When covering with a shell resin (shell), a polymerizable monomer containing an unsaturated double bond is added thereto and emulsion polymerization is performed in the presence of a surfactant. Thus, concurrently with polymerization, deposition onto the core surface is performed to obtain colored microparticles having a core/shell structure. The colored microparticles can be obtained by various methods. For example, an aqueous dispersion of resin microparticles is formed in advance through emulsion polymerization, then, an organic solvent solution containing a dye is added to the aqueous dispersion of resin microparticles to allow the dye to be impregnated in the resin microparticles to form colored microparticles. Then, a shell is formed on the colored microparticles as a core.

The shell is formed preferably of an organic resin. Shell formation (or shelling) can be performed by dropwise adding a resin dissolved in an organic solvent to allow deposited resin to adsorb onto the colored microparticle surface. In the preferred method of shell formation, colored microparticles as a core are formed, then, a polymerizable unsaturated monomer containing a double bond is added thereto in the presence of a surfactant to perform emulsion polymerization and the formed polymer is deposited on the core surface, forming a shell.

In this invention, the core/shell structure means a form in which at least two resins or dyes differing in composition exist, while being phase-separated from each other. In addition to the form of a shell completely covering the core portion, the shell may only partially cover the core. A part of a resin forming the shell may form a domain within the core. Further, it may be a multi-layer structure of at least least three layers including at one layer between the core portion and the shell portion.

In this invention, colored microparticles each form a core/shell structure. A core/shell structure having a colored portion formed of a resin and a dye of the colored microparticles, as a core, which is further covered with an exterior resin to form a shell.

Thermoplastic resin contained in the toner of this invention is preferably one which exhibits high adhesion to the colored microparticles, and a solvent-soluble thermoplastic resin is specifically preferred. When a precursor of a thermoplastic resin is solvent-soluble, a curable resin forming a three-dimensional structure is also usable.

Thermoplastic resins which are conventionally used as a binding resin for toners, are usable. Preferred examples thereof include acryl resin such as styrene resin, alkyl acrylate and alkyl methacrylate, styrene acryl copolymer resin, polyester resin, silicone resin, olefin resin, amide resin and epoxy resin. There is desired a resin exhibiting enhanced transparency and melt characteristics such as low viscosity and sharp-melting property to enhance transparency or color reproduction of superposed images. Styrene resin, acryl resin and polyester resin are suitable as a binding resin having such characteristics.

Thermoplastic resins having the following characteristics are preferred. Thus, the number-average molecular weight (Mn) is preferably from 3000 to 6000, and more preferably from 3500 to 5500. The ratio of the weight-average molecular weight (Mw) to the number-average molecular weight (Mn), that is Mw/Mn, is preferably from 2 to 6, and more preferably 2.5 to 5.5. The glass transition temperature is preferably from 50 to 70° C. and more preferably from 55 to 70° C. The softening temperature is preferably from 90 to 110° C., and more preferably from 90 to 105° C.

The use of a thermoplastic resin falling within the foregoing range of the number-average molecular weight preferably prevents such troubles that when a full-color solid image is bent, an image portion peels, causing image defects (or fixability on bending is deteriorated) and heat-fusibility in fixing is lowered. When a Mw/Mn is within the foregoing range, high temperature off-set hardly occurs, superior sharp melting characteristic results, and light-transmittance of a toner and mixing of color at the time of full color image formation can be prevented. The use of a thermoplastic resin having a glass transition point falling within the range described above can maintain heat resistance, causes no coagulation of toner particles during storage and can prevent color mixing at the time of forming full color images. The use of a thermoplastic resin falling within the foregoing range of the softening temperature can prevent occurrence of high temperature off-set, maintaining fixing strength, light-transmittance, color mixing and glossiness of full color images at a given level.

There will be now described resin forming the interior (or core) of the colored microparticle of this invention. Resins usable for the interior (core) of the colored microparticle are not specifically limited so long as it differs in composition from the thermoplastic resin described above. Examples thereof include (meth)acrylate resin, polyester resin, polyamide resin, polyimide resin, polystyrene resin, polyepoxy resin, polyester resin, amino type resin, fluorinated resin, phenol resin, polyurethane resin, polyethylene resin, polyvinyl chloride resin, polyvinyl alcohol resin, polyether resin, polyether ketone resin, polyphenylene sulfide resin, polycarbonate resin, and aramid resin. Of these resins, resins obtained by polymerization of ethylenically unsaturated monomers are preferred, such as (meth)acrylate resin, polystyrene resin, polyethylene resin, polyvinyl chloride resin and polyvinyl alcohol resin. (meth)acrylate resin and polystyrene resin are specifically preferred.

(Meth)acrylate resin can be synthesized by homopolymerization or copolymerization of various methacrylate monomers or acrylate monomers and a desired (meth)acrylate resin can be obtained by changing the kind of a monomer or composition ratio of monomers. The (meth)acrylate monomer may be copolymerized with copolymerizable unsaturated monomers other than the (meth)acrylate monomer or may be blended with other resins.

Examples of a monomer forming a (meth)acrylate resin include (meth)acrylic acid, methyl(meth)acrylate, ethyl (meth)acrylate, propyl(meth)acrylate, butyl(meth)acrylate, isopropyl(meth)acrylate, isobutyl(meth)acrylate, t-butyl (meth)acrylate, strearyl(meth)acrylate, 2-hydroxy(meth) acrylate, acetoacetoxyethyl(meth)acrylate, dimethylaminoethyl(meth)acrylate, 2-hydroxypropyl(meth)acrylate, di(ethylene glycol)ethyl ether(meth)acrylate, ethylene glycol methyl ether(meth)acrylate, isobonyl(meth)acrylate, chloroethyltrimethylammonium(meth)acrylate, trifluoroethyl (meth)acrylate, octafluoropentyl(meth)acrylate, 2-acetoamidomethyl(meth)acrylate, 2-methoxyethyl(meth)acrylate, 2-dimethylaminoethyl(meth)acrylate, 3-trimethoxysilanepropyl(meth)acrylate, benzyl(meth)acrylate, tridecyl (meth)acrylate, 4-hydroxybutyl(meth)acrylate, tetrahydrofuryl(meth)acrylate, dodecyl(meth)acrylate, octadecyl(meth) acrylate, 2-diethylaminoethyl(meth)acrylate, 2-ethylhexyl (meth)acrylate, cyclohexyl(meth)acrylate, phenyl(meth) acrylate, and glycidyl(meth)acrylate of these, (meth)acrylic acid, methyl(meth)acrylate, ethyl(meth)acrylate, propyl (meth)acrylatebutyl, butyl(meth)acrylate, stearyl(meth)acrylate, 2-hyroxyethyl(meth)acrylate, acetoacetoxyethyl(meth) acrylate, benzyl(meth)acrylate, tridecyl(meth)acrylate, dodecyl(meth)acrylate, and 2-ethylhexyl(meth)acrylate are preferred.

Polystyrene resins include a styrene homopolymer, and a random copolymer, block copolymer and graft copolymer obtained by copolymerization of a styrene monomer with other copolymerizable unsaturated monomers. A blend of such a styrene polymer and other polymers, or a polymer alloy is also usable.

Examples of a styrene monomer include styrene, an nuclear alkyl-substituted styrene such as α-methylstyrene, α-ethylstyrene, α-methylstyrene-p-methylstyrene, o-methylstyrene, or p-methylstyrene; and a nuclear halogen-substituted styrene such as o-chlorostyrene, m-chlorostyrene, p-bromoostyrene and tribromostyrene. Of these, styrene or α-methylstyrene is preferred.

The foregoing monomer components are subjected to homopolymerization or copolymerization to obtain resin usable in this invention. Examples thereof include a copolymer resin of a copolymer resin of benzylmethacrylate/ethyl acrylate or butyl acrylate, a copolymer resin of methyl methacrylate/2-ethylhexyl methacrylate, copolymer resin of methyl methacrylate/methacrylic acid/stearyl methactlate/acetoacetoxyethyl methacrylate, copolymer resin of styrene/acetoacetoxyethyl methacrylate/stearyl methacrylate, copolymer resin of styrene/2-hydroxyethyl methacrylate/stearyl methacrylate, and copolymer resin of 2-ethylhexyl methacrylate/2-hydroxyethyl methacrylate.

The number-average molecular weight of a resin used for the interior (core) is preferably from 500 to 100,000, and more preferably from 1,000 to 30,000 in terms of durability and microparticle-forming ability.

Resin used for a shell, which covers the interior (or core) of the colored microparticle to form a shell, is not specifically limited. Examples thereof include poly(meth)acrylate resin, polyester resin, polyamide resin, polyimideresin, polystyrene resin, polyepoxy resin, amino typeresin, fluorinated resin, phenol resin, polyurethane resin, polyethylene resin, polyvinyl chloride resin, polyvinyl alcohol resin, polyallylate resin, polyether resin polyether ketone resin, polyphenylene sulfide resin, polycarbonate resin and aramid resin. Of these, poly (meth)acrylate resin is preferred in terms of the combination with thermoplastic resin.

(Meth)acrylate resin can be synthesized by homopolymerization or copolymerization of various methacrylate monomers or acrylate monomers and a desired (meth)acrylate resin can be obtained by changing the kind of a monomer or composition ratio of monomers. The (meth)acrylate monomer may be blended with other resins.

Examples of a monomer forming a (meth)acrylate resin include (meth)acrylic acid, methyl(meth)acrylate, ethyl (meth)acrylate, propyl(meth)acrylate, butyl(meth)acrylate, isopropyl(meth)acrylate, isobutyl(meth)acrylate, t-butyl (meth)acrylate, strearyl(meth)acrylate, 2-hydroxy(meth) acrylate, acetoacetoxyethyl(meth)acrylate, dimethylaminoethyl(meth)acrylate, 2-hydroxypropyl(meth)acrylate, di(ethylene glycol)ethyl ether(meth)acrylate, ethylene glycol methyl ether(meth)acrylate, isobonyl(meth)acrylate, chloroethyltrimethylammonium(meth)acrylate, trifluoroethyl (meth)acrylate, octafluoropentyl(meth)acrylate, 2-acetoamidomethyl(meth)acrylate, 2-methoxyethyl(meth)acrylate, 2-dimethylaminoethyl(meth)acrylate, 3-trimethoxysilanepropyl(meth)acrylate, benzyl(meth)acrylate, tridecyl (meth)acrylate, 4-hydroxybutyl(meth)acrylate, tetrahydrofuryl(meth)acrylate, dodecyl(meth)acrylate, octadecyl(meth) acrylate, 2-diethylaminoethyl(meth)acrylate, 2-ethylhexyl (meth)acrylate, cyclohexyl(meth)acrylate, phenyl(meth) acrylate, and glycidyl(meth)acrylate. Of these, (meth)acrylic acid, methyl(meth)acrylate, ethyl(meth)acrylate, propyl (meth)acrylatebutyl, butyl(meth)acrylate, stearyl(meth)acrylate, 2-hyroxyethyl(meth)acrylate, acetoacetoxyethyl(meth) acrylate, benzyl(meth)acrylate, tridecyl(meth)acrylate, dodecyl(meth)acrylate, and 2-ethylhexyl(meth)acrylate are preferred; and methyl(meth)acrylate, ethyl(meth)acrylate, ropyl(meth)acrylate and butyl(meth)acrylate are moe preferred.

A resin used for the shell may be a copolymer with a reactive emulsifying agent. Reactive emulsifying agents usable in this invention may be anionic or nonionic ones but compounds containing the following substituent A, B or C:

A: straight chain or branched alkyl, or substituted or unsubstituted aromatic group having at least 6 carbon atoms, B: nonionic or anionic substituent expressing surface-activity, and C: radical-polymerizable group.

Example of a straight chain alkyl group described in the foregoing A include heptyl, octyl, nonyl and decyl; example of a branched alkyl group include 2-ethylhexyl; and example of an aromatic group include phenyl, nonylphenyl and naphthyl.

Example of a nonionic substituent expressing surface-activity (emulsifying capability), described in the foregoing B include polyethylene oxide, polypropylene oxid and their copolymer polyalkylene oxide. Example of an anionic substituent include a carboxylic acid, phosphoric acid, sulfonic acid and their salts. An anionic group which substitutes the terminal end of an alkylene oxide, is a specific example of the foregoing anionic substituent. The substituent of the foregoing B is preferably an anionic group, and more preferably one which forms a salt at the terminal end.

The radical-polymerizable group is a group capable of undergoing radical polymerization or a group capable of causing polymerization or cross-linking reaction via a radical active species. Examples thereof include groups containing an ethylenically unsaturated bond, such as a vinyl group, allyl group, isopropenyl group, acryl group, methacryl group, maleimide group, acrylamide group or styryl group.

Preferred emulsifying agents usable in this invention are compounds represented by formula (1) to (3) described below.

Formula (1)

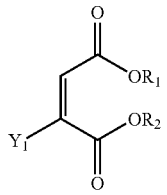

In the foregoing formula (1), $R_1$ is a straight chain or branched alkyl, or substituted or unsubstituted aromatic group having 6 to 20 carbon atoms group, for example, straight chain alkyl group such as heptyl, octyl, nonyl, decyl or dodecyl, a branched alkyl group such as 2-ethylhexyl, and an aromatic group such as phenyl, nonylphenyl, naphthyl, as described in the foregoing A; $R_2$ is a radical-polymerizable group, for example, a group containing an ethylenically unsaturated bond, such as acryl group, methacryl group or maleimide group, as described in the foregoing C; $Y_1$ is a sulfonic acid, carboxylic acid or their salts.

The compound of formula (1) can be synthesized by methods known in the art. It is also commercially available and examples thereof include LATEMUL S-120, LATEMUL S-120A, LATEMUL 180 and LATEMUL S-180A which are all available from Kao Corp.; and ELEMINOL JS-2, available from SANYO CHEMICAL INDUSTRIES, LTD.

Formula (2)

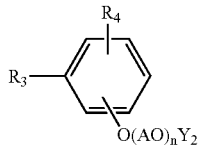

In the formula (2), $R_3$ is the same as defined in $R_1$ of the foregoing formula (1); $R_4$ is the same as defined in $R_2$ of the foregoing formula (1); $Y_2$ is a sulfonic acid, carboxylic acid or their salts; AO represents an alkylene oxide.

The compound of formula (2) can be synthesized by methods known in the art. It is also commercially available and examples thereof include NE-series of ADEKA REASOAP NE-10, ADEKA REASOAP NE-20 and ADEKA REASOAP NE-30, SE-series of ADEKA REASOAP SE-10N, ADEKA REASOAP SE-20N and ADEKA REASOAP SE-30N, which as all available from ASAHI DENKA KOGYO K.K.; RN-series of AQUALON RN-10, AQUALON RN-20, AQUALON RN-30, AQUALON RN-50, HS-series of AQUALON HS-10 and AQUALON HS-20, AQUALON HS-30, and AQUALON BC-series, which are all available from DAIICHI SEIYAKU CO., LTD.

Formula (3)

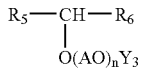

In the formula (3), $R_5$ is the same as defined in $R_1$ of the foregoing formula (1); $R_6$ is the same as defined in $R_2$ of the foregoing formula (1); $Y_2$ is the same as defined in $Y_1$ of the foregoing formula (2).

The compound of formula (3) can be synthesized by methods known in the art. It is also commercially available and examples thereof include KH-series of AQUALON KH-05, AQUALON KH-10, and AQUALON RN-20, which are all available from DAIICHI SEIYAKU CO., LTD.

In the foregoing formulas (2) and (3), the average polymerization degree (n) of an alkylene oxide chain (AO) is preferably from 1 to 10, including, for example, AQUALON KH-05, AQUALON KH-10, AQUALON HS-05, AQUALON HS-10, which are all available from DAIICHI SEIYAKU CO., LTD.

In this invention, anionic reactive emulsifying agents are preferred and examples thereof include ADEKA REASOAP SE-series (available from ASAHI DENKA KOGYO K.K., AQUALON HS-series, available from DAIICHI SEIYAKU CO., LTD., RAMTEL S-series, available from Kao Corp. and ELEMINOL JS-series, available from SANYO CHEMICAL-INDUSTRIES, LTD.

In this invention, the foregoing reactive emulsifying agents are used preferably in an amount of 0.1 to 80 parts by weight per 100 parts by weight of the total amount of resin forming colored microparticles, more preferably 1 to 70 parts by weight, and still more preferably 10 to 60 parts by weight.

In the process of preparation of colored microparticles relating to this invention, emulsification can be undergone optionally using conventional anionic emulsifying agents (surfactants) and/or nonionic emulsifying agents (surfactants).

Examples of conventional nonionic emulsifying agents include polyoxyethylene alkyl ethers such as polyoxyethylene lauryl ether and polyoxyethylene stearyl ether; polyoxyethylene alkylphenyl ethers such as polyoxyethylene nonylphenyl ether; sorbitan higher fatty acid esters such as sorbitan monolaurate, sorbitan monostearate, and sorbitan trioleate; polyoxyethylene sorbitan higher fatty acid esters, such as polyoxyethylene sorbitan monolaurate; polyoxyethylene higher fatty acid esters such as polyoxyethylene monolaurate and polyoxyethylene monostearate; glycerin higher fatty acid esters such as oleic acid monoglyceride and stearic acid monoglyceride; and polyoxyethylene-polyoxypropylene block copolymer.

Examples of conventional anionic emulsifying agents include higher fatty acid salts such as sodium oleate, alkylarylsulfonates such as sodium dodecylbenzenesulfonate, alkyl sulfuric acid esters such as sodium laurylsulfate, polyoxyethylene alkyl ether sulfuric acid ester salts such as polyethoxyethylene lauryl ether sulfuric acid sodium salt, polyoxyethylene alkylaryl ether sulfuric acid esters such as polyoxyethylene nonylphenyl ether sulfuric acid sodium salt, alkyl sulfosuccinic acid ester salts such as monooctyl sulfosuccinic acid sodium salt, dioctyl sulfosuccininc acid sodium salt, and polyoxyethylene laurylsulfosuccininc acid sodium salt, and derivatives of the foregoing.

There will be now described dyes contained in the colored microparticles of this invention. Generally known dyes are usable in this invention, and oil-soluble dyes are preferred and chelate dyes are more preferred.

Usually, oil-soluble dyes which do not contain any water-solubilizing group such as a carboxylic acid or sulfonic acid group, are soluble in organic solvents and not soluble in water, but a dye obtained by salt-formation of a water-soluble dye with a long chain base and thereby being soluble in oil, is also included. There are known, for example, an acid dye, a direct dye and a salt formation dye of a reactive dye with a long chain amine. Specific examples thereof are described below but are not limited to these: Valifast Yellow 4120, Valifast Yellow 3150, Valifast Yellow 3108, Valifast Yellow 2310N, Valifast Yellow 1101, Valifast Red 3320, Valifast Red 3304, Valifast Red 1306, Valifast Blue 2610, Valifast Blue 2606, Valifast Blue 1603, Oil Yellow GG-S, Oil Yellow 3G, Oil Yellow 129, Oil Yellow 107, Oil Yellow 105, Oil Scarlet 308, Oil Red RR, Oil Red OG, Oil Red 5B, Oil Pink 312, Oil Blue BOS, Oil Blue 613, Oil Blue 2N, Oil Black BY, Oil Black BS, Oil Black 860, Oil Black 5970, Oil Black 5906, Oil Black 5905, which are all available from Orient Kagaku Kogyo Co., Ltd.; Kayaset Yellow SF-G, Kayaset Yellow K-CL, Kayaset Yellow GN, Kayaset Yellow A-G, Kayaset Yellow 2G, Kayaset Red SF-4G, Kayaset Red K-BL, Kayaset Red A-BR, Kayaset Magenta 312, Kayaset Blue K-FL, which are all available from NIPPON KAYAKU CO., LTD.; FS Yellow 1015, FS Magenta 1404, FS cyan 1522, FS Blue 1504, C.I. Solvent Yellow 88, 83, 82, 79, 56, 29, 16, 14, 04, 03, 02, and 01; C.I. Solvent Red 84:1, C.I. Solvent Red 84, 218, 132, 73, 72, 51, 43, 27, 24, 18, and 01; Solvent Blue 70, 67, 44, 40, 35, 11, 02, and 01; C.I. Solvent Black 43, 70, 34, 29, 27, 22, 7, 3, and 3; C.I. Solvent Violet 3; C.I. Solvent Green 3 and 7; Plast Yellow DY352, Plast Red 8375, which are available from Arimoto Kagaku Kogyo Co., Ltd.; MS Yellow HD-180, MS Red G. MS Magenta HM-1450H, MS Blue HM-1384, which are available from Mitsui Kagaku Kogyo; ES Red 3001, ES Red 3002, ES Red 3003, TS Red 305, ES Yellow 1001, ES Yellow 1002, Ts Yellow 118, ES Orange 2001, ES Blue 6001, TS Tuyq Blue 618, which are available from SUMITOMO CHEMICAL CO., LTD.; ACROLEX Yellow 6G, Ceres Blue GNNEOPAN Yellow 075, Ceres Blue GN, MACROLEX Red and Violet R, which as available from Bayer Co.

Disperse dyes are also usable as an oil-soluble dye, examples thereof include C.I. Disperse Yellow 5, 42, 54, 64, 79, 82, 83, 93, 99, 100, 119, 122, 124, 126, 160, 184:1, 186, 198, 199, 204, 224 and 237; C.I. Disperse Orange 13, 29, 31:1, 33, 49, 54, 55, 66, 73, 118, 119 and 163; C.I. Disperse Red 54, 60, 72, 73, 86, 88, 91, 92, 93, 111, 126, 127, 134, 135, 143, 145, 152, 153, 154, 159, 164, 167:1, 177, 181, 204, 206, 207, 221, 239, 240, 258, 277, 278, 283, 311, 323, 343, 348, 356 and 362; C.I. Disperse Violet 33; C.I. Disperse Blue 56, 60, 73, 87, 113, 128, 143, 148, 154, 158, 165, 165:1, 165:2, 176, 183, 185, 197, 198, 201, 214, 224, 225, 257, 266, 267, 287, 354, 358, 365 and 368; C.I. Disperse green 6:1 and 9.

In addition, phenol, naphthols; cyclic methylene as pyrazolone and pyrazolotriazole, couplers such as ring-opening methylene compounds, p-diaminopyridines, azomethine dyes and indoaniline dyes are also usable as an oil-soluble dye.

A metal chelate dye usable in this invention refers to a compound in which a dye coordinates with a metal ion through at least two-dentate coordination and which may contain a ligand other than the dye. The ligand refers to an atomic group capable of coordinating with a metal ion, which may contain a charge or not. Metal chelate dyes usable in this invention are, for example, compounds represented by the following formula (4):

$$M(Dye)_L(A)_m \qquad \text{formula (4)}$$

wherein M is a metal ion, "Dye" is a dye capable of coordinating with a metal ion, A is a ligand except for that the Dye, L is 1, 2 or 3, and m is 0, 1, 2 or 3, provided that when m is 0, L is 2 or 3, in which plural "Dye"s may be the same or different. The metal ion represented by M is a metal ion chosen from groups 1 to 9 inclusive of the periodical table of elements, for example, Al, Co, Co, Cr, Cu, Fe, Mn, Mo, Ni, Sn, Ti, Pt, Pd, Zr, and Zn. Ni, Cu, Cr, Co, Zn, and Zn ions are specifically preferred.

Chelate dyes described in JP-A Nos. 9-277693, 10-20559 and 10-30061 are specifically preferred, which is a metal chelate dye formed by allowing at least one dye represented by the following formulas (1) to (6) to be bonded to a metal ion through coordination of the coordination number (or dentate number) of 2 or more:

formula (1)

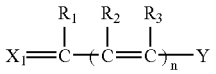

formula (2)

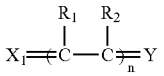

formula (3)

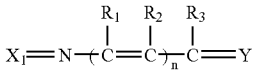

$X_1{=}N{-}Y$ formula (4)

$X_2{-}N{=}N{-}Y$ formula (5)

formula (6)

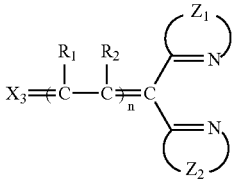

In the foregoing formulas (1) to (5), $X_1$ and $X_2$ are each a group forming a dye through a conjugated system and represent a group or atomic group which is capable of forming a chelate of bi- or more-dentate; Y is an atomic group necessary to form an aromatic carbon ring or a 5- or 6-membered heterocyclic ring. In the formula (6), $X_3$ is an atomic group capable of linking via a conjugated system; $Z_1$ and $Z_2$ are each an atomic group necessary to form a nitrogen-containing heterocyclic ring, in which $Z_1$ and $Z_2$ may be the same or different. In the formulas (1) to (3) and (6), $R_1$, $R_2$ and $R_3$ are each a hydrogen atom, a halogen atom or a univalent substituent; and n is 0, 1 or 2.
Specific Examples of such a metal chelate dye usable in this invention are shown below but are by no means limited to these.
D-1
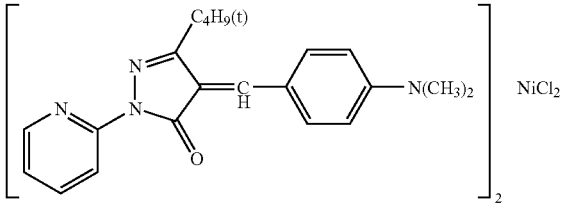
D-2
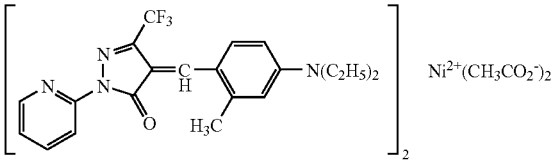
D-3
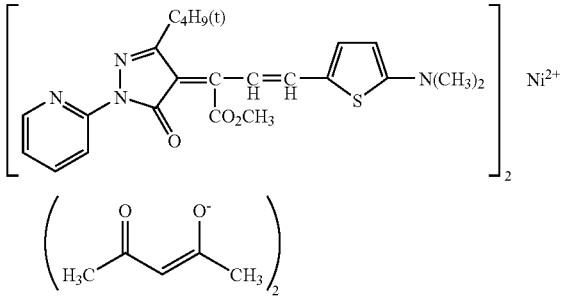
D-4
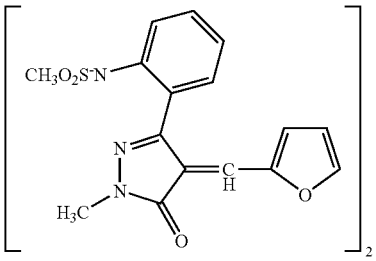
D-5
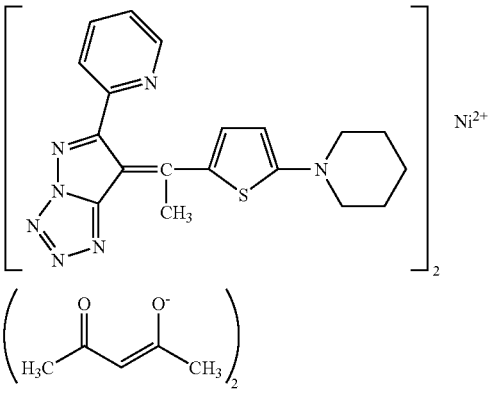
-continued
D-6
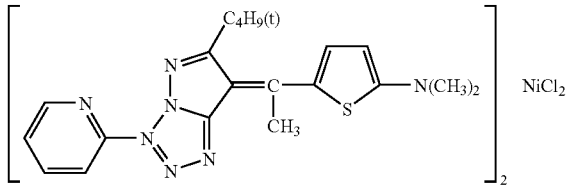
D-7
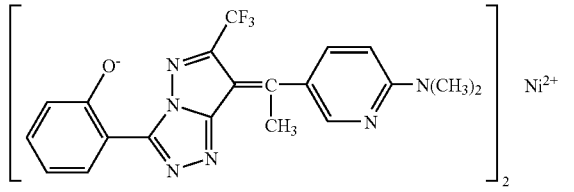
D-8
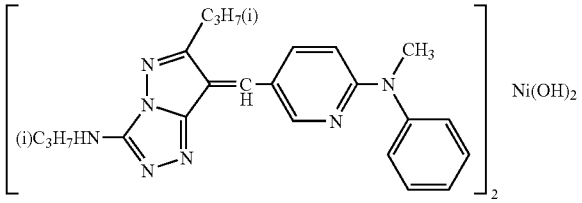
D-9
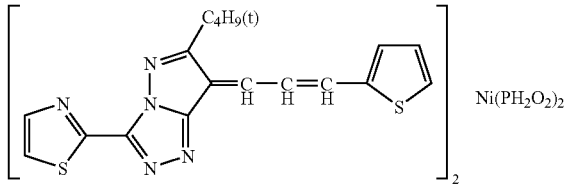
D-10
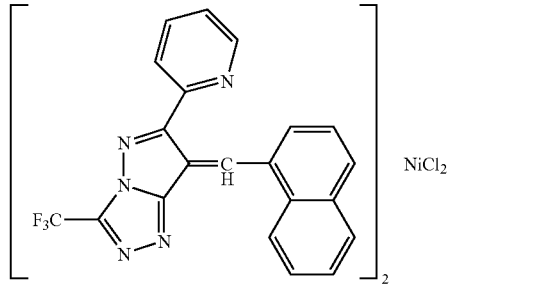
D-11
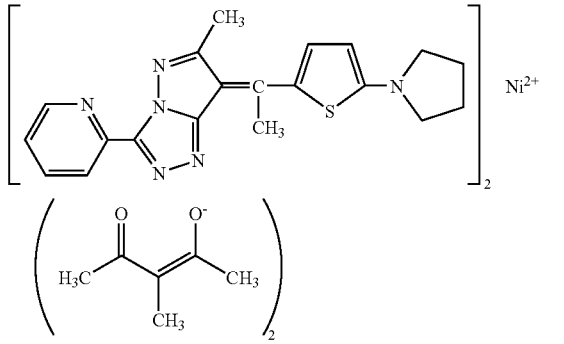

-continued
D-12
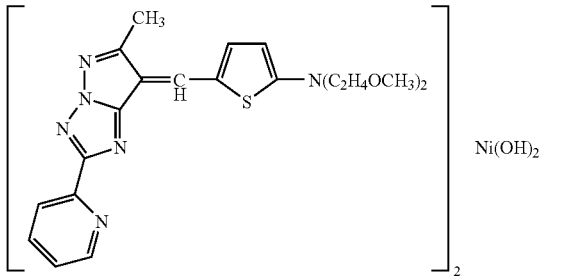
D-13
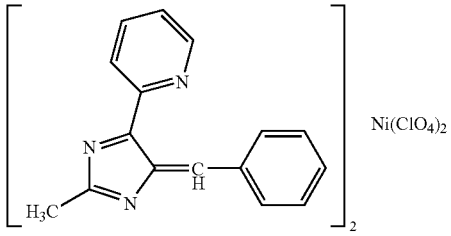
D-14
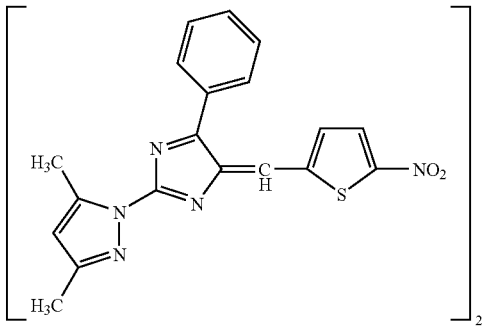
D-15
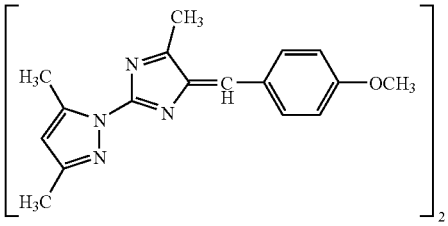
D-16
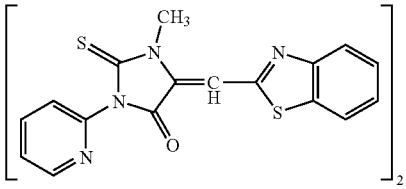
D-17
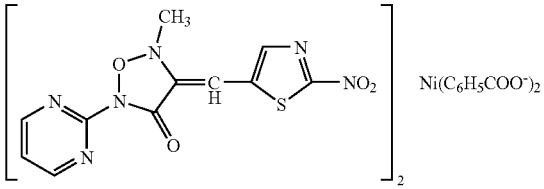
-continued
D-18
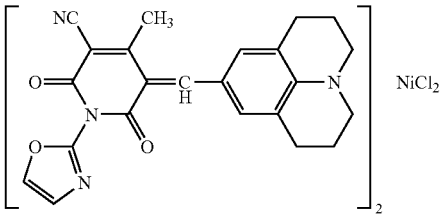
D-19
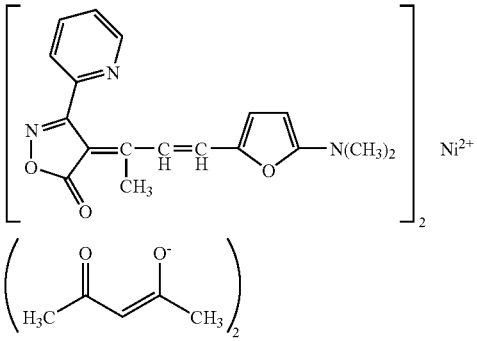
D-20
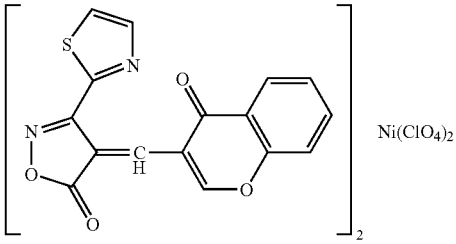
D-21
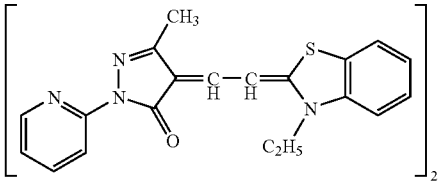
D-22
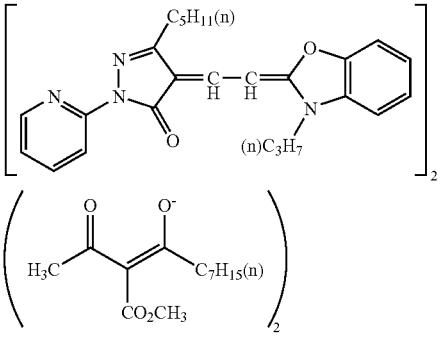
D-23
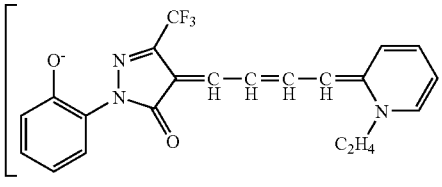

-continued
D-24
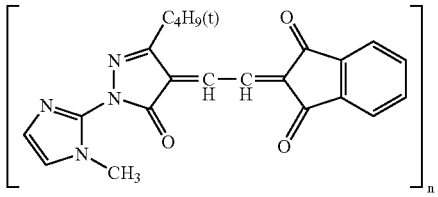
$Ni(ClO_4)_2$
D-25
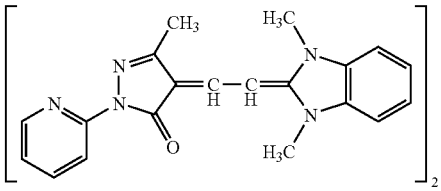
$Ni(CF_3COO^-)_2$
D-26
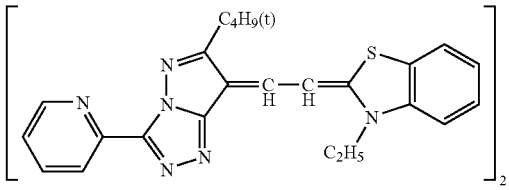
$NiCl_2$
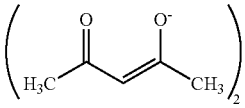
D-27
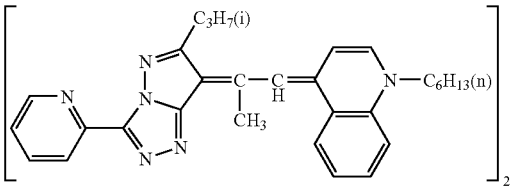
$NiCl_2$
D-28
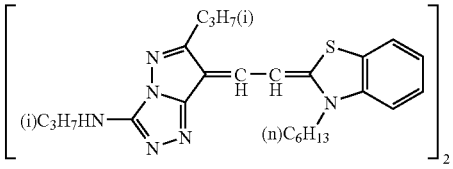
$Ni(CH_3SO_3^-)_2$
D-29
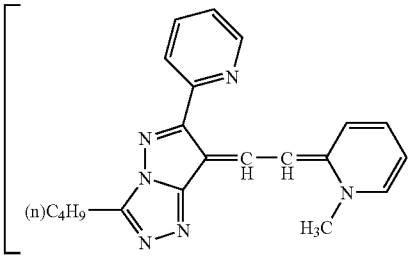
$Zn(ClO_4)_2$
-continued
D-30
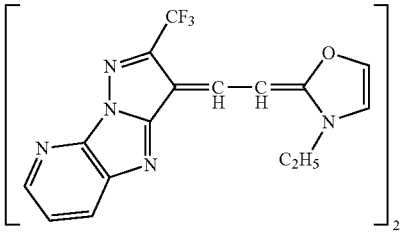
$Ni[B(C_2H_5)]$
D-31
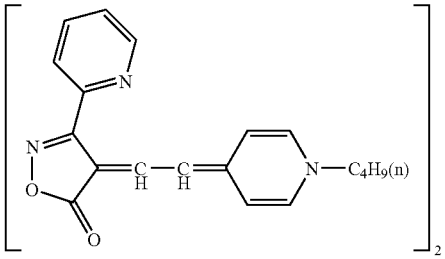
$Ni(OH)_2$
D-32
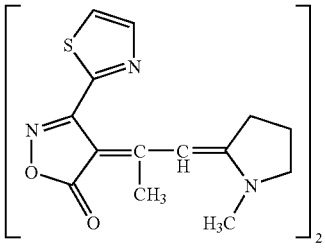
$Ni(CH_3COO^-)_2$
D-33
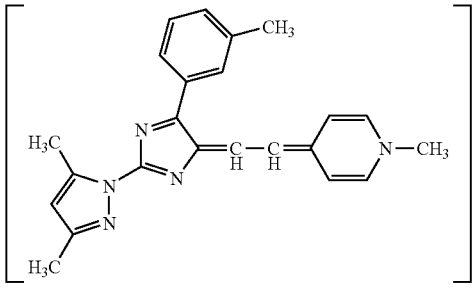
$CoCl_2$
D-34
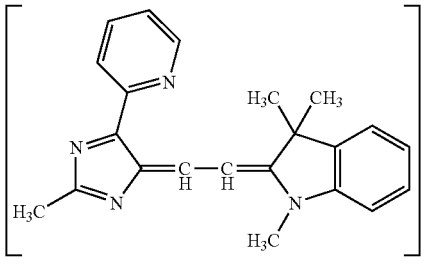
$Ni(C_6H_5SO_3^-)_2$ -continued
D-35
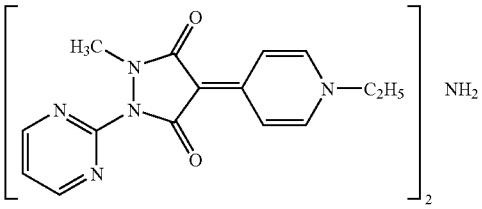
$NH_2$
D-36
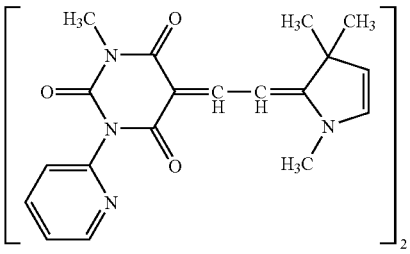
$Ni(ClO_4)_2$
D-37
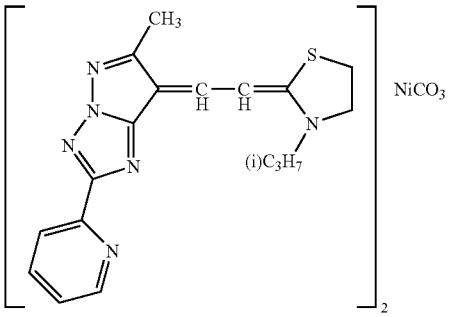
$NiCO_3$
D-38
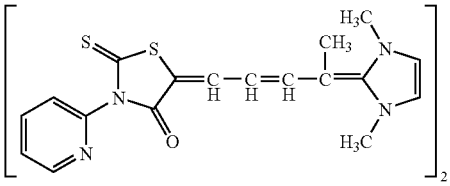
$NiCl_2$
D-39
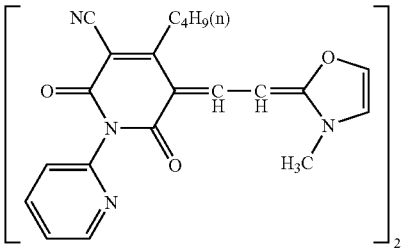
$NiBr_2$
D-40
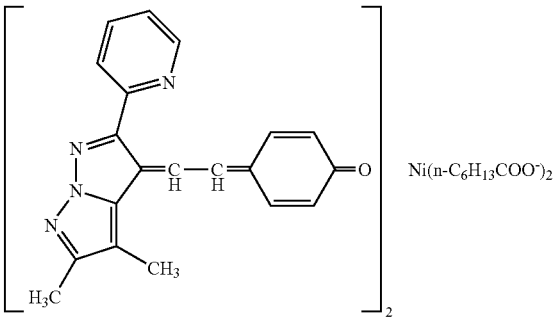
$Ni(n\text{-}C_6H_{13}COO^-)_2$
-continued
D-41
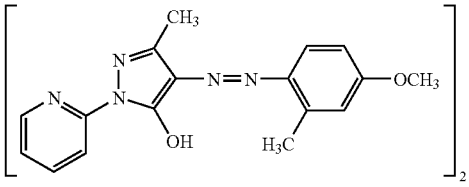
$NiBr_2$
D-42
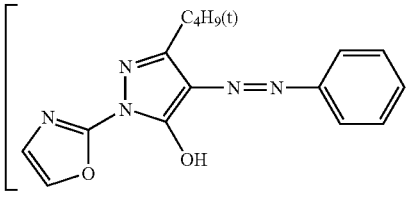
$CuCl_2$
D-43
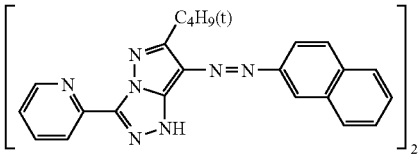
$Ni^{2+}(CH_3COO^-)_2$
D-44
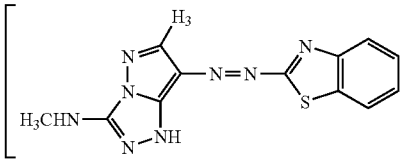
$Ni^{2+}$
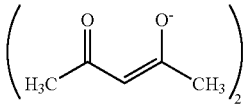
D-45
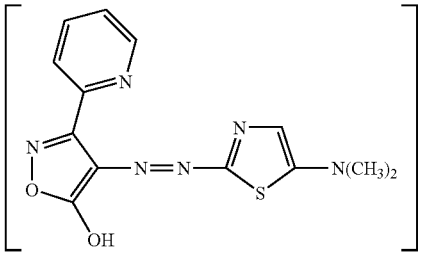
$Ni(OH)_2$
D-46
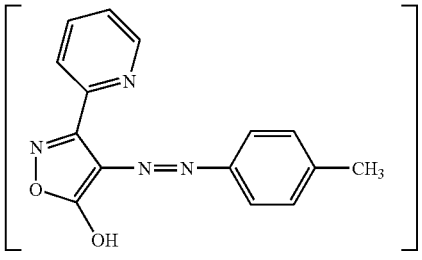
$CoCl_2$ -continued
D-47
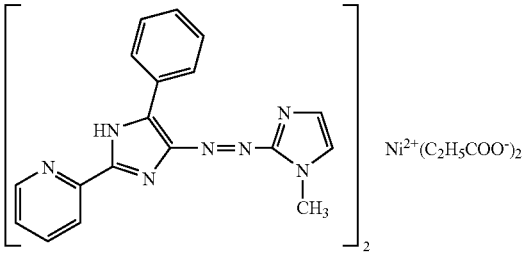
D-48
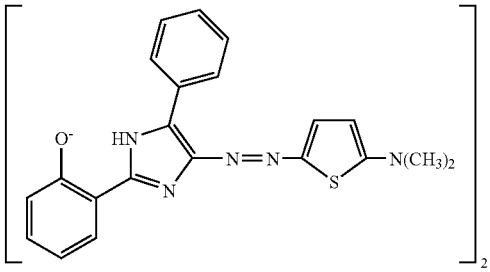
D-49
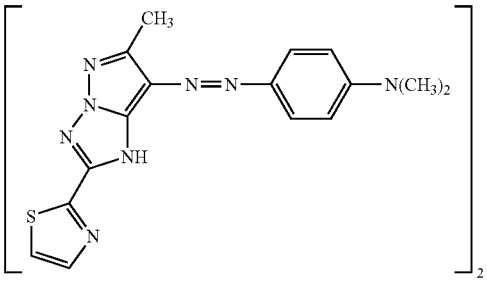
D-50
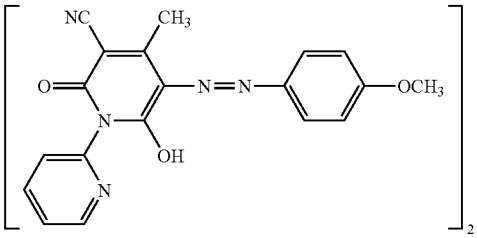
D-51
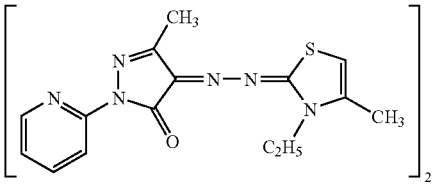
D-52
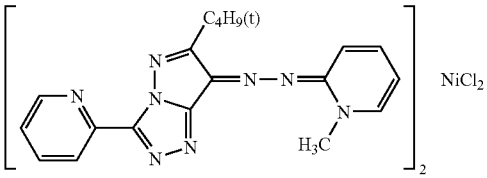
-continued
D-53
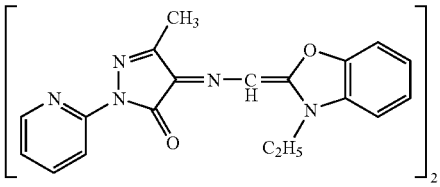
D-54
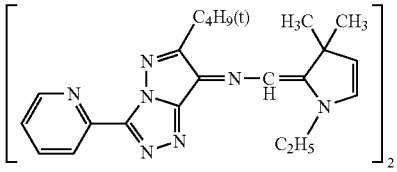
D-55
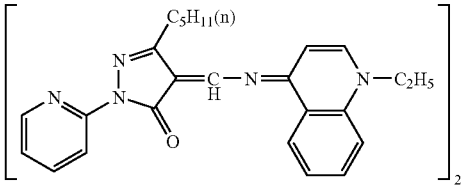
D-56
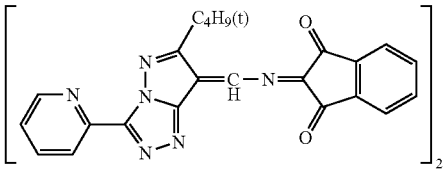
D-57
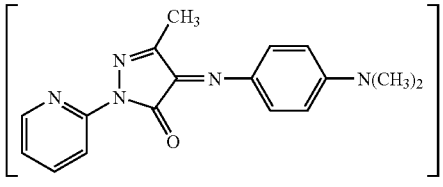
D-58
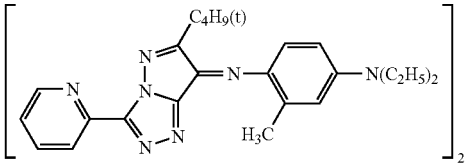
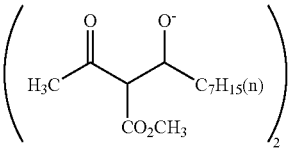
D-59
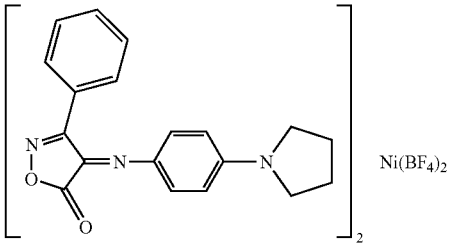

-continued
D-60
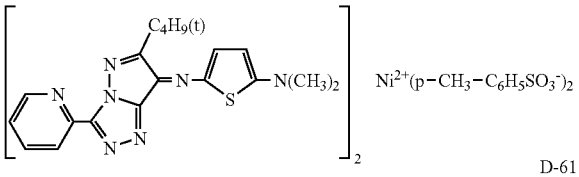
$Ni^{2+}(p-CH_3-C_6H_5SO_3^-)_2$
D-61
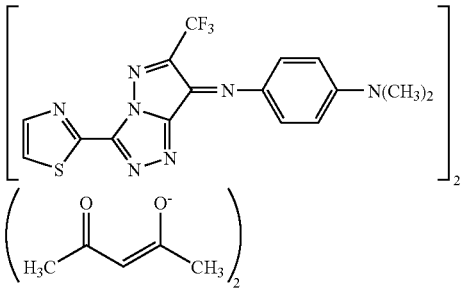
D-62
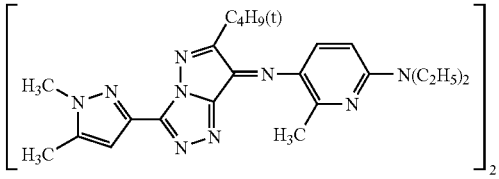
$NiCl_2$
D-63
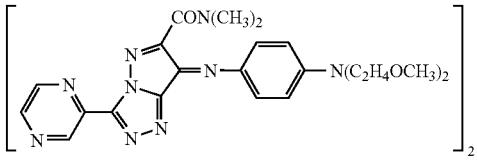
$Ni(OH)_2$
D-64
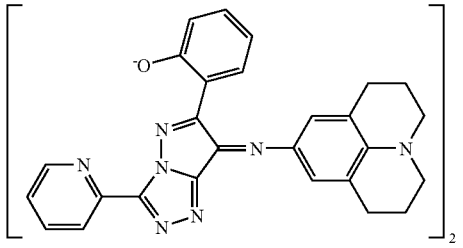
D-65
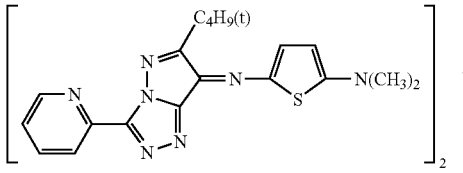
$NiCl_2$
D-66
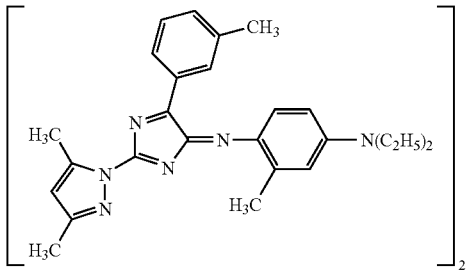
$NiCl_3$
-continued
D-67
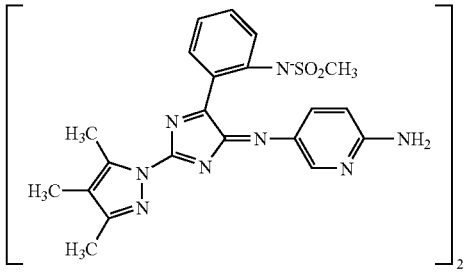
D-68
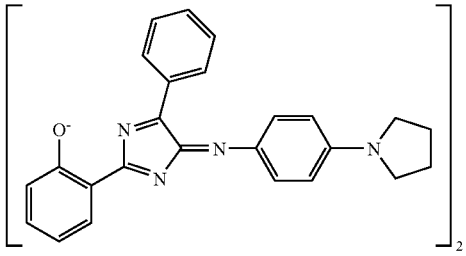
D-69
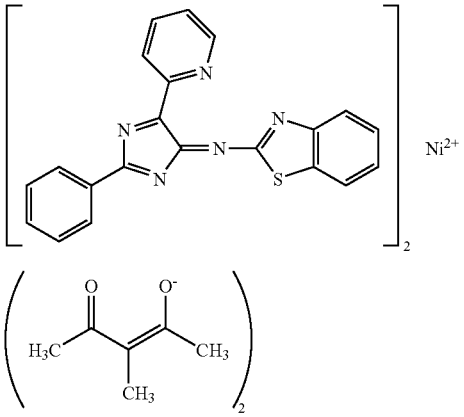
D-70
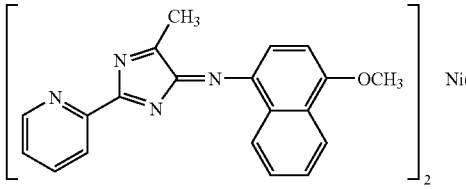
$Ni(ClO_4)_2$
D-71
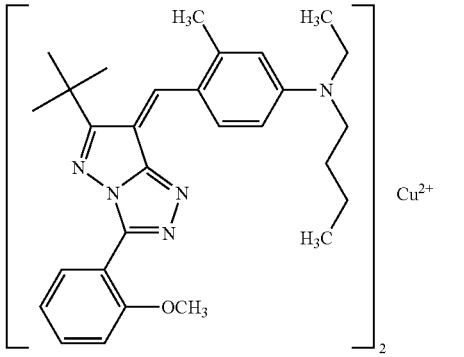

-continued
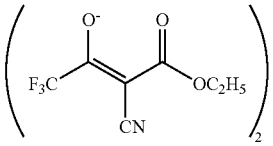
D-72
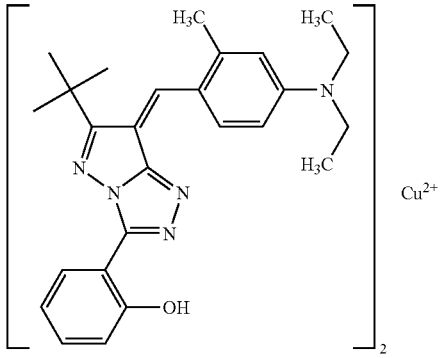
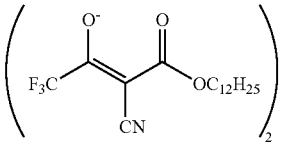
D-73
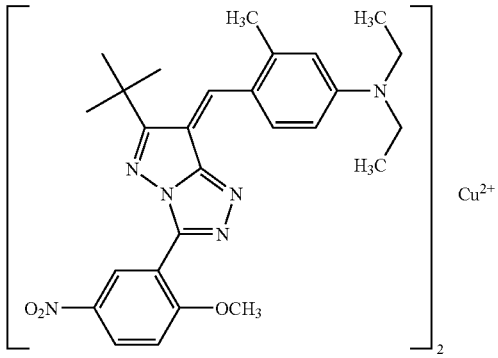
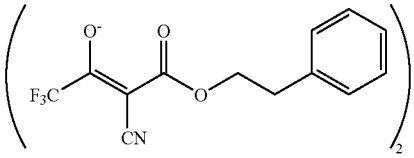
D-74
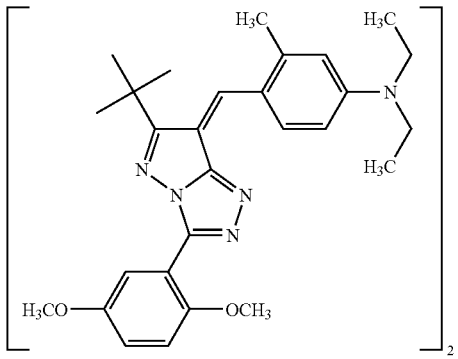
-continued
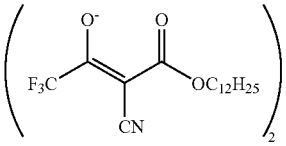
D-75
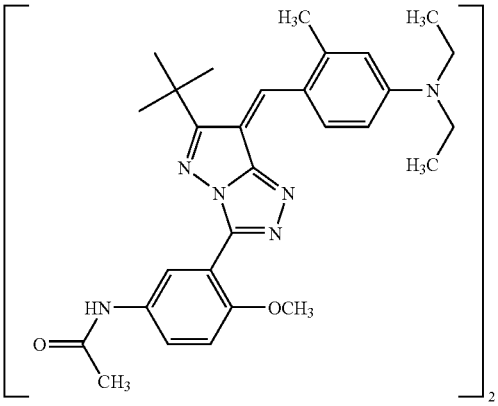
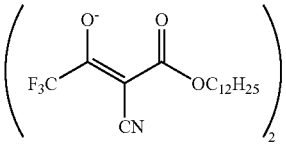
D-76
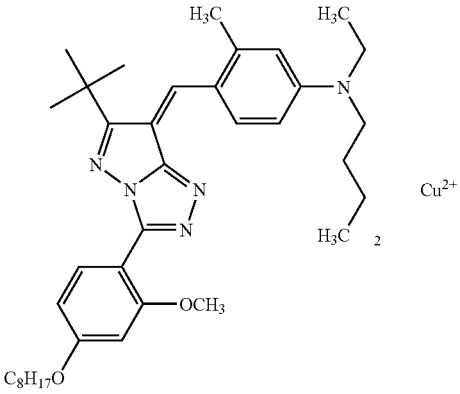
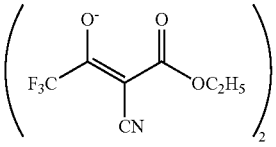
D-77
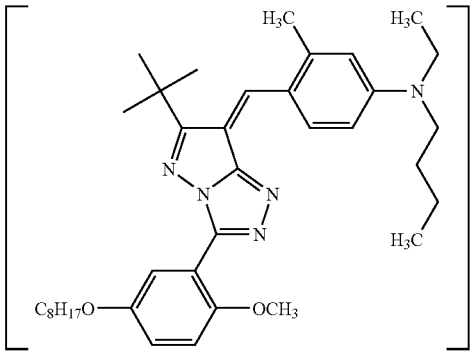

-continued
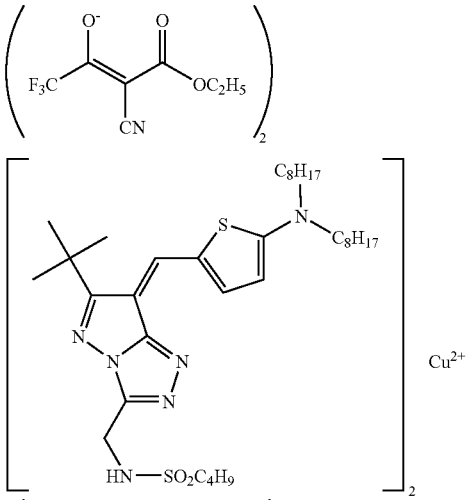
D-78
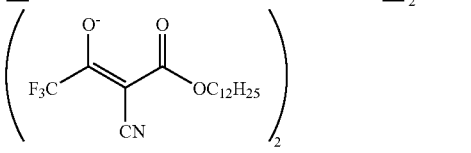
D-79
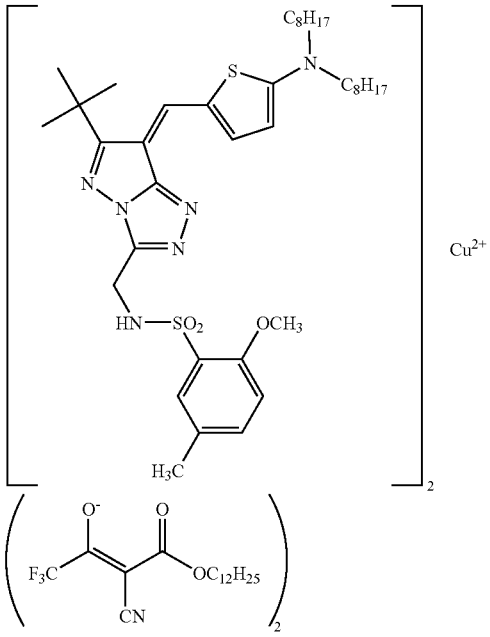
D-80
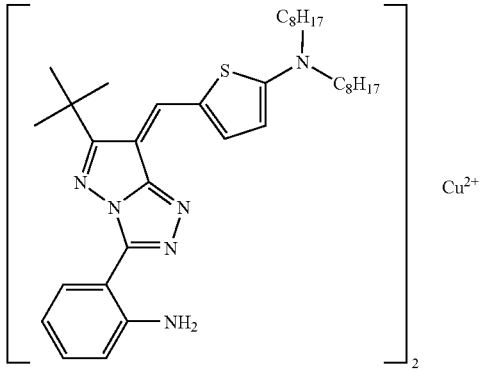
-continued
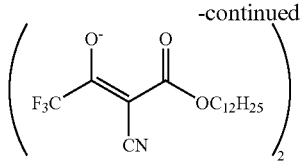
D-81
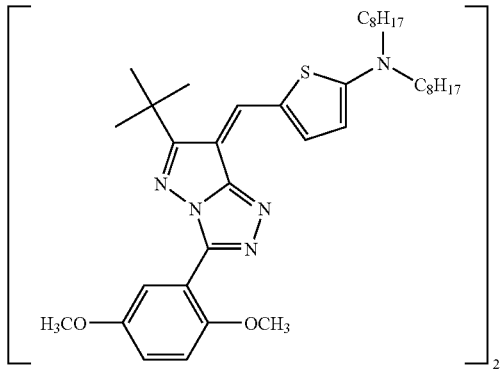
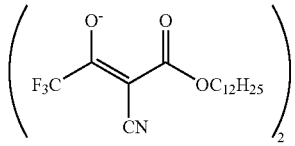
D-82
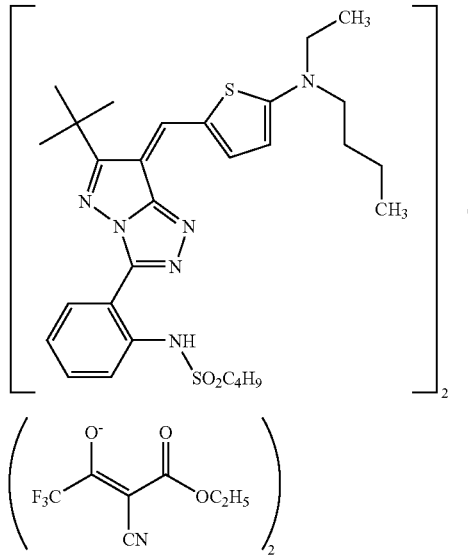
D-83
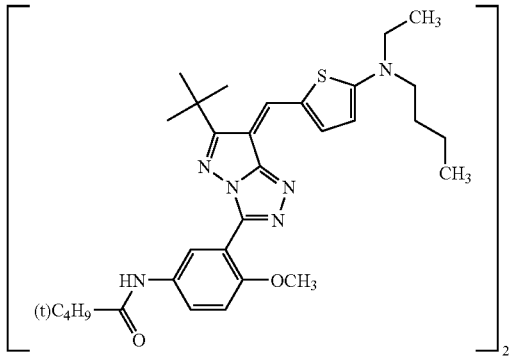

-continued
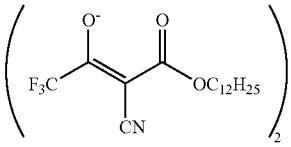
D-84
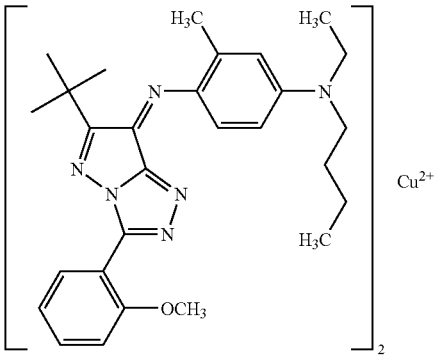
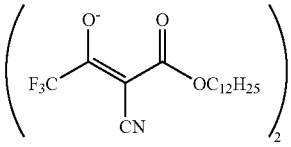
D-85
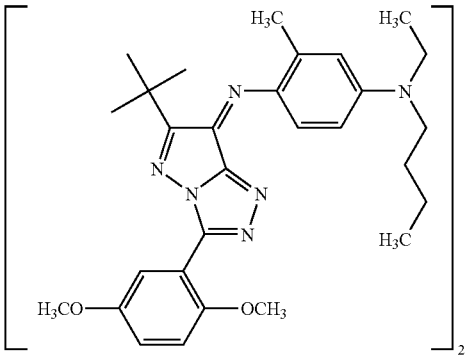
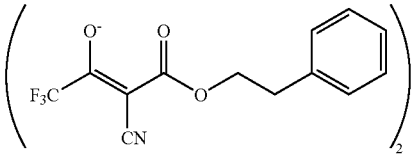
D-86
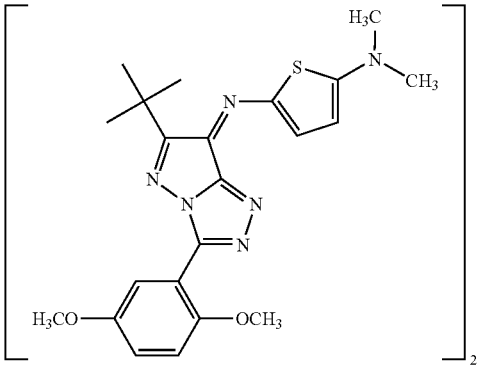
-continued
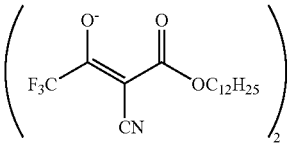
D-87
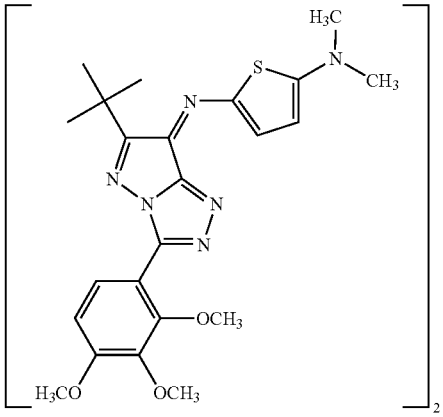
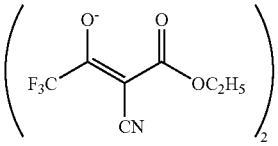
D-88
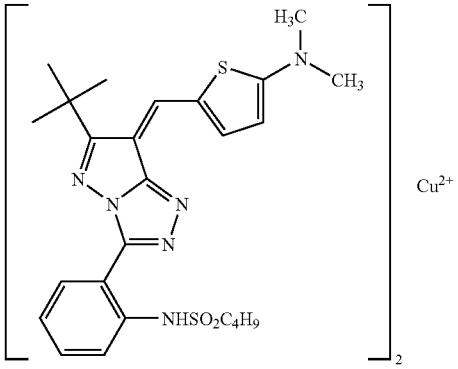
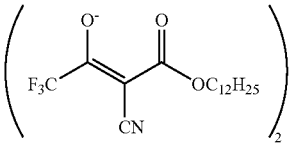
D-89
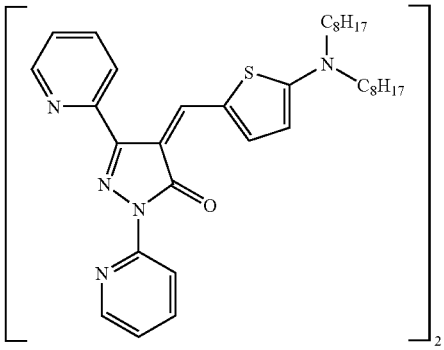

-continued

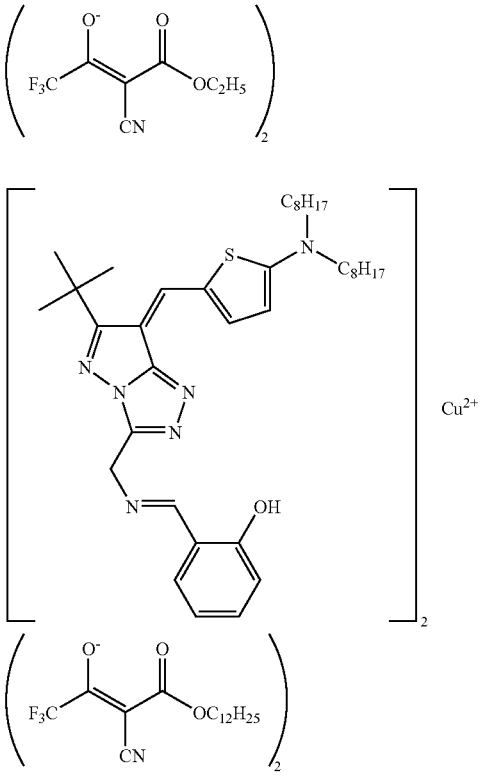

D-90

The volume-average particle size of the colored microparticles relating to this invention is preferably 10 nm to 1 μm, and more preferably 20 to 500 nm. A volume-average particle size falling within the foregoing range effects inclusion of a dye into resin of the colored microparticle, easily maintaining standing stability of colored microparticles and leading to superior storage stability. Further, in the process of preparation of colored microparticles, sedimentation is prevented and standing stability is also maintained. When used as a toner, glossiness or transparency is achieved.

The volume-average particle size can be determined by the dynamic light scattering method, laser diffraction method, centrifugal sedimentation method, FFF method or electric detector method. In this invention determination in the dynamic light scattering method using "Zeta Sizer" (produced by Marbahn CO.) is preferable.

The dye content of the colored microparticle is preferably from 10% to 70% by weight, based on the microparticle. A dye content falling within the foregoing range can obtain a sufficient image density, expresses protective capability for the dye and exhibits superior storage stability as a microparticle dispersion, thereby preventing an increase of the particle size due to aggregation.

In addition to the foregoing thermoplastic resin and colored microparticles, a charge control agent or a off-set preventing agent known in the art may be incorporated to the toner of this invention.

Charge control agents usable in this invention are not specifically limited. As a negative charge control agent used for color toners are usable colorless, white or light color charge control agents. Preferred example thereof include zinc or chromium metal complex of salicylic acid derivatives, carixarene compounds, organic borane compounds, and fluorine-containing quaternary ammonium salt compounds. There are-usable salicylic acid metal complexes described, for example, in JP-A Nos. 53-127726 and 62-145255; carixarene compounds described, for example, in JP-A No. 2-201378; organic borane compounds described, for example, in JP-A Nos. 2-221967 and 3-1162. Such a charge control agent is used preferably in an amount of 0.1 to 10 parts by weight per 100 parts by weight of thermoplastic resin (binding resin), and more preferably 0.5 to 5.0 parts by weight.

Off-set preventing agents usable in this invention are not specifically limited and specific examples thereof include polyethylene wax, oxidation type polyethylene wax, polypropylene wax, oxidation type polypropylene wax, carnauba wax, sazole wax, rice wax, candelilla wax, jojoba wax, and bees wax. Such a wax is used preferably in an amount of 0.5 to 5.0 parts by weight per 100 parts by weight of thermoplastic resin, and more preferably 1.0 to 3.0 parts by weight. Incorporation of an off-set preventing agent within the foregoing range displays its effects, resulting in superior light-transmittance and color reproduction.

Using a thermoplastic resin, colored microparticles and other desired additives, the toner of this invention can be manufactured by commonly known methods such as a kneading and grinding method, suspension polymerization method, emulsion polymerization method, emulsion granulation method, or capsulation method. Of the foregoing methods, taking into account the decrease of the toner particle size along with enhancement of image quality, the emulsion polymerization method is preferable in terms of manufacturing cost and manufacturing stability.

A thermoplastic resin emulsion prepared by emulsion polymerization is mixed with a dispersion of toner particle components such as colored microparticles. While maintaining balance between repulsion force of the particle surface, formed by pH adjustment and aggregation force due to addition of an electrolyte, aggregation is gradually performed. Association is performed with controlling the particle size and the particle size distribution, while stirring with heating. Thereby, fusion of microparticles and particle shape control are conducted to manufacture the toner particles.

The volume-average particle size of the toner relating to this invention is preferably 4-10 μm in terms of high precise image reproduction, and more preferably 6 to 9 μm. The volume-average particle size can be determined by Coulter Counter TA-II (produced by Coulter Corp.).

In this invention, the thus prepared toner particles may be used as it is, but preferably, external additives may be incorporated to the toner particles to control electrostatic charge or enhance fluidity or cleaning ability. Examples of such external additives include inorganic oxide particles such as particulate silica, particulate alumina, and particulate titania, inorganic stearate compound particles such particulate aluminum stearate or particulate zinc stearate, and inorganic titanate compound particles such as strontium titanate or zinc titanate. These additives may be used singly or in combination. These particles are desirably used together with a surface treatment of a silane coupling agent, titan coupling agent, higher fatty acid or silicone oil in terms of environmental resistance stability and heat resistance maintenance. The external additive is incorporated preferably in an amount of 0.05 to 5 parts by weight per 100 parts by weight of toner particles, and more preferably from 0.1 to 3 parts by weight.

The toner of this invention may be mixed with a carrier and used as a toner used for a two-component developer, or may be used as a toner used for a single-component developer.

Conventional carriers used for a two-component developer can be used in combination with the toner of this invention. There can be used, for example, a carrier composed of magnetic material particles such as iron or ferrite, a resin-coated carrier formed by covering magnetic material particles with resin and a binder type carrier obtained by dispersing powdery magnetic material in a binder. Of these carriers, the use of a resin-coated carrier using silicone resin, copolymer resin (graft resin) of an organopolysioxane and a vinyl monomer or polyester resin is preferred from the viewpoint of toner spent and the like. Specifically, a carrier coated with a resin which is obtained by reacting isocyanate with a copolymer resin of an organopolysiloxane and a vinyl monomer, is preferred in terms of fastness, ecological concerns and resistance to spent toner. A monomer containing a substituent such as a hydroxyl group having reactivity with an isocyanate needs to be used as the above-described vinyl monomer. The volume-average particle size of a carrier is preferably 15 to 100 μm to maintain high image quality and prevent a carrier from fogging. The volume-average particle size of the carrier can be determined using a laser diffraction type particle size distribution measurement apparatus, HELOS (produced by SYMPATEC Corp.).

Next, there will be described an image formation method using the toner of this invention.

In this invention, the system of image formation is not specifically limited. Examples thereof include a system in which plural images are formed on a photoreceptor and transferred all together, a system in which an image formed on a photoreceptor is successively transferred using a transfer belt and is not specifically limited to such, of which the system in which plural images are formed on a photoreceptor and transferred all together is preferred.

In this system, the photoreceptor is uniformly charged and exposed according to the first image and the first development is performed to form the first toner image on the photoreceptor. Subsequently, the photoreceptot having formed the first toner image is uniformly charged, exposed according to the second image and the second development is performed to the second toner image. Further, the photoreceptor having formed the first and second toner images is uniformly charged, exposed according to the third image and the third development is performed to form the third toner image on the photoreceptor. Furthermore, the photoreceptor having formed the first, second and third toner images is uniformly charged, exposed according to the fourth image and the fourth development is performed to form the fourth toner image on the photoreceptor. In the foregoing, the first development is performed with a yellow toner, the second development is performed with a magenta toner, the third development is performed with a cyan toner and the fourth development is performed with a black toner to form a full color image. Thereafter, images formed on the photoreceptor are transferred all together to a transfer material such as paper and fixed on the transfer material to form images. In this system, images formed on the photoreceptor are transferred all together to paper or the like to form the final image, so that differing from a so-called intermediate system, the transfer, which often perturbs the previous images, is done only one time, resulting in enhanced image quality.

Since a plural number of development processes need to be performed to develop latent images formed on the photoreceptor, a non-contact development system is preferred. A system in which an alternant electric field is applied during development, is also preferable.

Suitable fixing systems usable in this invention include a so-called contact heating system. Representative examples of the contact heating system include a heat roll fixing system and a pressure heat-fixing system in which fixing is performed using a rolling pressure member including a fixed heating body.

In the image formation process to perform development, transfer and fixing by using a toner of this invention, the toner transferred onto a transfer material, e.g., paper, adheres onto the paper surface without colored microparticles being disintegrated, even after fixing.

In conventional toners obtained by directly dispersing or dissolving a dye in a thermoplastic resin (binding resin), the dye bleeds out onto the toner particle surface, producing the following problems: (1) low charging, (2) marked difference in charging between high temperature and high humidity, and low temperature and low humidity, (3) the charging amount varying depending on the kind of dye as a colorant, for example, when using pigments of cyan, magenta, yellow and black in full color recording. However, in this invention, colored microparticles are dispersed within the toner particle so that in spite of the toner particle having the dye at a relatively high content, the dye does not bleed out on the particle surface, overcoming the foregoing problems.

Further, when thermally fixed onto a transfer material, transport of a dye as colorant to the outside of the colored microparticles (bleeding-out onto the surface of the colored microparticle) does not result and does not produce problems sublimation of a dye or oil staining during thermal fixing, as tends to be caused with conventional toners.

EXAMPLES

The present invention will be further described based on examples, but are by no means limited to these.

Colored Microparticle

Preparation of Dispersion of Colored Microparticle 1

To a separable flask were added 13.5 g of resin (P-1), 16.3 g of dye (A-1) and 123.5 of acetic acid and after the atmosphere in interior was replaced with nitrogen gas, the dye was completely dissolved with stirring. Further thereto, 238 g of an aqueous solution 8.0 g of AQUALON KH-50 (produced by DAIICHI SEIYAKU CO., LTD.) was dropwise added with stirring and then emulsified for 300 sec. using CLEAR-MIX W-MOTION CLM-0.8W (produced by M-TECHNIQUE Co.). Thereafter, acetic acid was removed under reduced pressure to obtain a dispersion of colored microparticles 1 containing a dye. In the thus obtained dispersion, the volume-average particle size of colored particles was 30 nm. Hereinafter, the volume-average particle size was determined using ZETASIZER (Marbahn Co.).

Resin (P-1): St/AAEM/SMA/=50/30/20

ST: styrene

AAEM: acetoacetoxyethyl methacrylate

SMA: stearyl methacrylate

Dye (A-1)

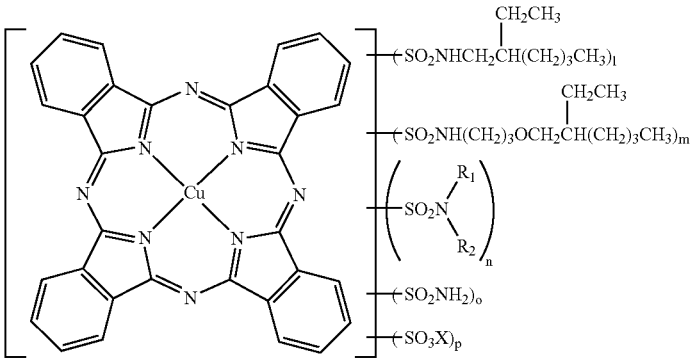

Preparation of Dispersion of Colored Microparticle 2

A dispersion of colored microparticle 2 was prepared similarly to the foregoing dispersion of colored microparticle 1, provided that, further to the dispersion of colored microparticle 1, 0.5 g of potassium persulfate was added and heated at 70° C. using a heated and 10.0 g of methyl methacrylate was dropwise added and allowed to react for 5 hr. The thus obtained dispersion of colored particle 2 was core/shell type colored particles having a shell resin (shell) layer formed on the surface of the colored particle 1 as a core. In the thus obtained dispersion, the volume-average particle size of colored particles was 33 nm.

Preparation of Dispersion of Colored Microparticle 3

A dispersion of core/shell type colored microparticle 3 was prepared similarly to the foregoing dispersion of colored microparticle 2, provided that the resin (P-1) and dye (A-1) were replaced by resin (P-2) and dye (A-2), respectively. In the thus obtained dispersion, the volume-average particle size of colored particles was 45 nm.

Resin (P-2: St/HEMA/SMA=30/40/30

HEMA: 2-hydroxyethyl methacrylate

Dye (A-2)

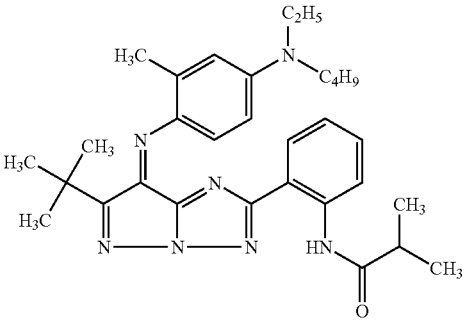

Preparation of Dispersion of Colored Microparticle 4

A dispersion of core/shell type colored microparticle 4 was prepared similarly to the foregoing dispersion of colored microparticle 2, provided that the resin (P-1) and dye (A-1) were replaced by resin (P-2) and dye (A-3), respectively and methyl methacrylate was replaced by acrylonitrile. In the thus obtained dispersion, the volume-average particle size of colored particles was 70 nm.

Dye (A-3)

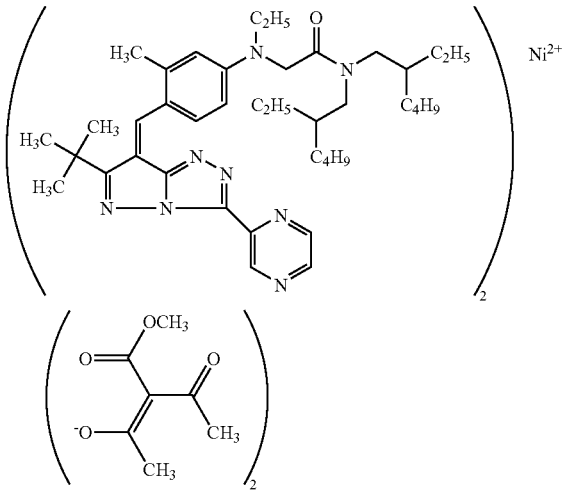

Preparation of Dispersion of Colored Microparticle 5

A dispersion of core/shell type colored microparticle 5 was prepared similarly to the foregoing dispersion of colored microparticle 2, provided that the amount of AQUALON KH-50 was changed varied from 8.0 g to 1.0 g. In the thus obtained dispersion, the volume-average particle size of colored particles was 120 nm.

Preparation of Dispersion of Colored Microparticle 6

A dispersion of core/shell type colored microparticle 6 was prepared similarly to the foregoing dispersion of colored microparticle 2, provided that the amount of dye (A-1) was changed varied from 16.0 g to 1.0 g. In the thus obtained dispersion, the volume-average particle size of colored particles was 28 nm.

Preparation of Dispersion of Colored Microparticle 7

A dispersion of core/shell type colored microparticle 7 was prepared similarly to the foregoing dispersion of colored microparticle 2, provided that the amount of dye (A-1) was changed varied from 16.0 g to 40.0 g. In the thus obtained dispersion, the volume-average particle size of colored particles was 198 nm.

Preparation of Dispersion of Colored Microparticle 8

A dispersion of core/shell type colored microparticle 8 was prepared similarly to the foregoing dispersion of colored microparticle 2, provided that the resin (P-1) and dye (A-1) were replaced by resin (P-3), and dye (A-4), respectively. In the thus obtained dispersion, the volume-average particle size of colored particles was 51 nm.

Resin (P-3): ST/HEMA/SMA=20/40/40

ST: styrene

HEMA: 2-hydroxythyl methacrylate

SMA: stearyl methacrylate

Dye (A-4)

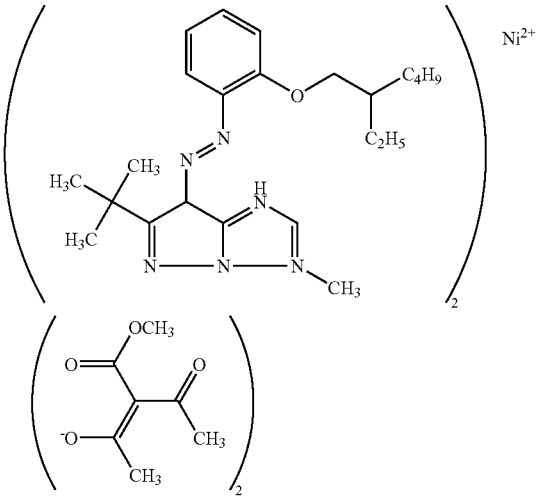

In Table 1 are shown the kind of core resin, shell resin or dye used in the foregoing colored microparticles and the volume-average particle size of the colored microparticles.

TABLE 1

| Colored Microparticle No. | Core Resin | Shell Resin | Dye | Volume-average Particle Size (nm) |
|---|---|---|---|---|
| 1 | P-1 | — | A-1 | 30 |
| 2 | P-1 | MMA | A-1 | 33 |
| 3 | P-2 | MMA | A-2 | 45 |
| 4 | P-2 | AN | A-3 | 70 |
| 5 | P-1 | MMA | A-1 | 1200 |
| 6 | P-1 | MMA | A-1 | 28 |
| 7 | P-1 | MMA | A-1 | 198 |
| 8 | P-3 | MMA | A-4 | 51 |

MMA: methyl methacrylate
AN: acrylonitrile

Toner

Preparation of Thermoplastic Resin (Latex)

Into 5,000 ml separable flask fitted with a stirring device, a temperature sensor, a condenser and a nitrogen-introducing was charged an aqueous surfactant solution (aqueous medium) of 7.08 g of an anionic surfactant (sodium dodecylbenzenesulfonate) which was previously dissolved in 2760 g of deionized water and the internal temperature was increased with stirring at a stirring rate of 230 rpm under a stream of nitrogen. Separately, 72.0 g of a compound of the following Formula (1) as releasing agent was added to a monomer mixture of 115.2 g of styrene, 42.0 g of n-butyl acrylate and 10.9 g of methacrylic acid and dissolved with heating at 80° C. to prepare a monomer solution. Using a mechanical disperser having a circulation path, the monomer solution (80° C.) was mixed with the foregoing aqueous surfactant solution (80° C.) and stirred to prepare a dispersion of emulsion particles (oil droplets) having a uniform dispersion particle size. Subsequently, to this dispersion, a polymerization initiator solution of 0.84 g of a polymerization initiator (potassium persulfate, KPS) dissolved in 200 g of deionized water was added and heated at 80° c. for 3 hr. with stirring to perform polymerization (first polymerization) to form a latex. Then, to this latex, a polymerization solution of 7.73 g of a polymerization initiator (KPS) dissolved in 240 g of deionized water was added. After 15 min, a monomer mixture of 383.6 g of styrene, 140.0 g of n-butyl acrylate, 36.4 g of methacrylic acid and 13.7 g of tert-dodecylmercaptan was added dropwise at 80° C. over a period of 126 min. After completing addition, stirring continued for 60 min. with heating to perform polymerization (second polymerization). Then the reaction mixture was cooled to 40° C. to obtain a latex. The thus obtained latex was designated as latex (1).

Formula (1)

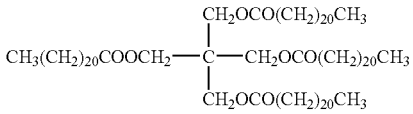

Preparation of Toner Particle

Into 5 lit. separable flask fitted with a stirring device, a temperature sensor, a condenser and a nitrogen-introducing was charged 1250 g of the latex (1), 2,000 ml of deionized water and the dispersion of colored microparticle 1. After adjusting t interior temperature to 30° C., the reaction mixture was adjusted to a pH 10.0 by adding a 5N aqueous sodium hydroxide solution. Then, an aqueous solution of 52.6 g of magnesium chloride hexahydride which was previously dissolved in 72 ml of deionized water, was added at 30° C. in 10 min. After allowed to stand for 3 min., heating was started and the reaction system was heated to 90° C. in 6 min. (at a temperature-increasing rate of 10° C./min). From that state, measurement of the aggregated particle size was started using Coulter Counter TA-II (produced by Coulter Corp.). When the volume-average particle size reached 6.5 μm, an aqueous solution of sodium chloride of 115 g dissolved in 700 mol of deionized water to stop grain growth and the reaction mixture was further stirred for 6 hr. with maintaining the temperature at 90±2° C. to continue fusion. Thereafter, the reaction mixture was cooled to 30° C. at a rate of 6° C./min. The aggregated particles were filtered off from dispersion of the aggregated particles and dispersed in deionized water in an amount of 10 times the weight of aggregated particles to perform washing. After repeating the procedure of washing and filtration twice, washing was done with deionized water and drying was done by hot air at 40° C. to obtain toner particles. The thus obtained toner particles were designated "toner particle 1".

Preparation of Toner Particle 2

Toner particles were prepared similarly to the foregoing toner particle 1, except that the dispersion of colored microparticle 1 was replaced by the dispersion of colored microparticle 2. The thus obtained toner particles were designated "toner particle 2".

Preparation of Toner Particle 3

Toner particles were prepared similarly to the foregoing toner particle 1, except that the dispersion of colored microparticle 1 was replaced by the dispersion of colored microparticle 3. The thus obtained toner particles were designated "toner particle 3".

Preparation of Toner Particle 4

Toner particles were prepared similarly to the foregoing toner particle 1, except that the dispersion of colored microparticle 1 was replaced by the dispersion of colored microparticle 4. The thus obtained toner particles were designated "toner particle 4".

Preparation of Toner Particle 5

Toner particles were prepared similarly to the foregoing toner particle 1, except that the dispersion of colored microparticle 1 was replaced by the dispersion of colored microparticle 5. The thus obtained toner particles were designated "toner particle 5".

Preparation of Toner Particle 6

Toner particles were prepared similarly to the foregoing toner particle 1, except that the dispersion of colored microparticle 1 was replaced by the dispersion of colored microparticle 6. The thus obtained toner particles were designated "toner particle 6".

Preparation of Toner Particle 7

Toner particles were prepared similarly to the foregoing toner particle 1, except that the dispersion of colored microparticle 1 was replaced by the dispersion of colored microparticle 7. The thus obtained toner particles were designated "toner particle 7".

Preparation of Toner Particle 8

Toner particles were prepared similarly to the foregoing toner particle 1, except that the dispersion of colored microparticle 1 was replaced by the dispersion of colored microparticle 8. The thus obtained toner particles were designated "toner particle 8".

Preparation of Toner Particle 9

Using a surfactant, a low molecular weight polypropylene (number-average molecular weight of 3200) was dispersed in water at a solid content of 30% by weight to prepare an emulsion of low molecular weight polypropylene. To 60 g of the thus prepared low molecular weight polypropylene emulsion was added 338 g of the dispersion of colored microparticle 1. Further thereto, 220 g of styrene monomer, 40 g of n-butyl acrylate monomer, 12 g of methacrylic acid monomer, 5.4 g of t-dodecylmercaptan as a chain-transfer and 2,000 ml of degassed water were added, and maintained at 70° C. for 3 hr. with stirring under a stream of nitrogen to perform emulsion polymerization.

The thus obtained particular resin dispersion was adjusted to a pH of 7.0 with sodium hydroxide. Then, 700 ml of an aqueous 2.7 mol % potassium chloride solution was added thereto 420 ml of isopropyl alcohol and 23.4 g of polyoxyethylene octylphenyl ether (ethylene oxide average polymerization degree of 10), which was previously dissolved in 175 ml of pure water and maintained for 6 hr. at 75° C. with stirring to perform reaction. Thereafter, the reaction mixture was cooled to 30° C. at a rate of 6° C./min. The aggregated particles were filtered off from dispersion of the aggregated particles and dispersed in deionized water in an amount of 10 times the weight of aggregated particles to perform washing. After repeating the procedure of washing and filtration twice, washing was done with deionized water and drying was done by hot air at 40° C. to obtain toner particles. The thus obtained toner particles were designated "toner particle 9".

Preparation of Toner Particle 10

To an aqueous solution of sodium dodecylsulfate dissolved in 200 ml of pure water, 20 g of dye (A-1) was added, stirred and dispersed by ultrasonic to prepare a colored particle dispersion. Using a surfactant, a low molecular weight polypropylene (number-average molecular weight of 3200) was dispersed in water at a solid content of 30% by weight to prepare an emulsion of low molecular weight polypropylene. To 60 g of the thus prepared low molecular weight polypropylene emulsion was added 338 g of the dispersion of colored microparticle 1. Further thereto, 220 g of styrene monomer, 40 g of n-butyl acrylate monomer, 12 g of methacrylic acid monomer, 5.4 g of t-dodecylmercaptan as a chain-transfer and 2,000 ml of degassed water were added, and maintained at 70° C. for 3 hr. with stirring under a stream of nitrogen to perform emulsion polymerization.

The thus obtained particular resin dispersion was adjusted to a pH of 7.0 with sodium hydroxide. Then, 675 ml of an aqueous 2.7 mol% potassium chloride solution was added thereto 400 ml of isopropyl alcohol and 22.5 g of polyoxyethylene octylphenyl ether (ethylene oxide average polymerization degree of 10), which was previously dissolved in 168 ml of pure water and maintained for 6 hr. at 75° C. with stirring to perform reaction. Thereafter, the reaction mixture was cooled to 30° C. at a rate of 6° C./min. The aggregated particles were filtered off from dispersion of the aggregated particles and dispersed in deionized water in an amount of 10 times the weight of aggregated particles to perform washing. After repeating the procedure of washing and filtration twice, washing was done with deionized water and drying was done by hot air at 40° C. to obtain toner particles. The thus obtained toner particles were designated "toner particle 10".

Preparation of Toner Particle 11

Toner particles were prepared similarly to the foregoing toner particle 9, except that the dye (A-1) was replaced by C.I. Pigment Blue 15-3 (produced by Dainippon Ink Kagaku Kogyo). The thus obtained toner particles were designated "toner particle 11".

To each of the toner particle 1 to 11, hydrophobic silica (having a number-average particle size of 12 nm and a hydrophobicity degree of 68) and hydrophobic titanium (having a number-average particle size of 20 nm and a hydrophobicity degree of 63) as external additives were added at 1% by weight and 1.2% by weight, respectively and mixed for 15 min. using a Henschel mixer Produced by Mitsui Miike Kako-sha). Thereafter, coarse particles were removed using a sieve having an opening of 45 μm to obtain Toners 1 to 11. These were also denoted "Inv. 1 to 9" and "Comp. 1 and 2".

Preparation of Developer

A silicone resin-covered ferrite carrier having a volume-average particle size of 60 μm was mixed with each of the foregoing toners 1 to 11 at a toner content of 6% by weight to obtain "developer 1" to "Developer 11".

Evaluation

Digital copier Konica 7075 (produced by Konica Minolta Business Technology, Inc.) was used as an apparatus for evaluation, in which a fixing device was modified as below.

A heat-roll fixing system was used as a fixing device. Thus, a heating roller was formed by covering the core surface of an aluminum alloy cylinder (having an inside diameter of 40 mm, a thickness of 1.0 mm and a total width of 310 mm) including a heater in the central portion, using a 120 μm thick tube of copolymer of tetrafluoroethylene and perfluoroalkyl vinyl ether (PFA). A pressure roller was formed by covering the core surface of an iron cylinder (having an inside diameter of 40 mm and a thickness of 2.0 mm), using a sponge-form silicone rubber (having an ASKER C hardness of 48 and a thickness of 2 mm). The heating roller was brought into contact with the pressure roller to form a 5.5 mm wide nip. Using this fixing apparatus, the print speed was set to 480 mm/sec. A supply system in which a web system was impregnated with polydiphenylsilicone (exhibiting a viscosity of 10 Pa·s at 20° C.), was employed as a cleaning mechanism of the fixing device. The fixing temperature was controlled based on the surface temperature of the heating roller (setting temperature: 175° C.). The coating amount of silicone oil was 0.1 mg/A4.

Evaluation was made under an environment of ordinary temperature and ordinary humidity (25° C., 55% RH) and the development conditions were set as follows:

Photoreceptor surface potential: −700 V

DC bias: −500 V

Dsd (distance between photoreceptor and development sleeve): 600 μm

Developer layer control: magnet type (H-Cut system)

Developer layer thickness: 700 μm

Development sleeve: 40 mm.

Using the toners obtained above in the apparatus for evaluation under the foregoing evaluation conditions, practical picture tests were done on fine-quality paper and an OHP sheet, and evaluation was made with respect to (1) color reproduction, (2) transparency, (3) charging property, (4) off-set resistance and (5) heat resistance of the respective toners.

(1) Color Reproduction

Color reproduction of monochrome images was visually evaluated by ten persons based on the following criteria. Evaluation was conducted in a toner-deposit amount of 0.7±0.05 mg/cm$^2$.

A: excellent color reproduction,

B: superior color reproduction,

C: slight color staining but acceptable in practice,

D: marked color staining and unacceptable in practice.

(2) Transparency

A transparent image formed on an OHP sheet was prepared and the fixed image was measured with respect to visible spectral absorbance by Type 330 Spectrophotometer (produced by HITACHI) using an OHP sheet having no toner as a reference. There were determined the difference in absorbance between 650 nm and 450 nm of a yellow toner, the difference in absorbance between 650 nm and 550 nm of a magenta toner, and the difference in absorbance between 500 nm and 600 nm of a cyan toner. Transparency of the individual OHP image was evaluated based on the following criteria, in which a value of at least 70% was judged to be good transparency. Evaluation was conducted in a toner deposit amount of 0.7±0.05 mg/cm$^2$.

A: 90% or more, being superior,

B: 70%-90%, being good

C: less than 70%, being no good.

(3) Charging Property

Evaluation of charging property was conducted by varying the electrostatic charge of every print. Thus, based on the following criteria, the value of Qb/Qa was evaluated, where Qa is the electrostatic charge after setting a developer and making the first print and Qb is the electrostatic charge after completion of printing of 1,000,000 sheets.

A: not less than 0.9 and less than 1.1, being superior,

B: not less than 0.8 and less than 0.9, or not less than 1.1 and less than 1.2, being good, C: not less than 0.7 and less than 0.8, or not less than 1.2 and less than 1.3, being acceptable in practice, D: less than 0.7 or more than 1.3, being unacceptable in practice.

(4) Off-Set Resistance 10,000 A4 sheets of fine-quality paper having a solid strip image of a 5 mm width vertical to the transport direction were transported vertically and fixed. Then, 10,000 A4 sheets of fine-quality paper having a half-tone image of a 20 mm width vertical to the transport direction were transported in horizontally form and fixed, and running a machine was stopped. After the machine was stopped overnight, the machine was restarted and the presence or absence of image staining due to an after-fixing off-set phenomenon, occurring on the first sheet was visually evaluated based on the following criteria:

A: no occurrence of staining on images,

B: occurrence of slight staining on images but being acceptable in practice,

C: occurrence of marked staining and being unacceptable in practice.

(5) Heat Resistance

A fixing roller and recovered silicone oil were visually observed and coloring was visually evaluated based on the following criteria:

A: no coloring was observed on the fixing roller and silicone oil,

B: coloring was observed in fixing roller and silicone oil.

The evaluation results are shown in Table 2.

TABLE 2

| | Toner Particle No. | Color Reproduction | Transparency | Charging Property | Off-set Resistance | Heat Resistance |
|---|---|---|---|---|---|---|
| Inv. 1 | 1 | A | A | B | B | A |
| Inv. 2 | 2 | A | A | A | A | A |
| Inv. 3 | 3 | B | A | A | A | A |
| Inv. 4 | 4 | A | A | A | A | A |
| Inv. 5 | 5 | B | B | A | A | A |
| Inv. 6 | 6 | B | A | A | A | A |
| Inv. 7 | 7 | B | B | B | B | A |
| Inv. 8 | 8 | A | A | A | A | A |
| Inv. 9 | 9 | A | A | B | A | A |
| Comp. 1 | 10 | A | A | B | C | B |
| Comp. 2 | 11 | B | C | B | B | A |

As apparent from Table 2, it was proved that toners of Inv. 1 to Inv. 9 achieved superior color reproduction, transparency, charging property and off-set resistance, and no coloring due to a dye was observed in the fixing roller and recovered silicone oil, leading to superior heating resistance.

What is claimed is:

1. An electrophotographic toner comprising a thermoplastic resin and colored microparticles dispersed in the thermoplastic resin, and the colored microparticles comprising a dye and a resin (1) differing in composition from the thermoplastic resin, wherein the colored microparticles each comprise a core and a shell, and the core comprising the dye and the resin (1) and the shell covering the core and comprising a resin (2).

2. The toner of claim 1, wherein the dye is an oil-soluble dye.

3. The toner of claim 1, wherein the dye is a metal chelate dye.

4. The toner of claim 1, wherein the colored microparticles have a volume-average particle size of 10 nm to 1 μm.

5. The toner of claim 2, wherein the resin (2) is a (meth) acrylate resin.

6. The toner of claim 1, wherein the dye content of the colored microparticles is 10% to 70% by weight.

7. An image forming method comprising:

imagewise exposing a uniformly charged photoreceptor to form an electrostatic latent image, developing the electrostatic latent image with a toner to form a toner image and transfer the toner image to a transfer material, wherein the toner is a toner as claimed in claim 1.

* * * * *